US006826874B2

(12) United States Patent
Takeuchi et al.

(10) Patent No.: US 6,826,874 B2
(45) Date of Patent: Dec. 7, 2004

(54) BUCKLING RESTRAINED BRACES AND DAMPING STEEL STRUCTURES

(75) Inventors: Toru Takeuchi, Tokyo (JP); Hiroshi Nakamura, Tokyo (JP); Isao Kimura, Tokyo (JP); Hisami Hasegawa, Tokyo (JP); Eiichiro Saeki, Tokyo (JP); Atsushi Watanabe, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/735,252

(22) Filed: Dec. 12, 2000

(65) Prior Publication Data

US 2001/0000840 A1 May 10, 2001

Related U.S. Application Data

(63) Continuation-in-part of application No. 09/511,207, filed on Feb. 23, 2000, now abandoned.

(30) Foreign Application Priority Data

Jun. 30, 1999 (JP) ..... 11-186384
Dec. 8, 1999 (JP) ..... 11-349175
Jun. 26, 2000 (JP) ..... 2000-191718

(51) Int. Cl.[7] ..... E04B 1/98; E04H 9/02
(52) U.S. Cl. ..... 52/167.3; 52/167.1; 52/724.5; 52/723.1
(58) Field of Search ..... 52/167.1, 724.1, 52/724.5, 723.1, 167.3

(56) References Cited

U.S. PATENT DOCUMENTS 2,844,023 A * 7/1958 Maiwurm ..... 52/724.5
5,471,810 A * 12/1995 Sugisawa et al. ..... 52/167.3

FOREIGN PATENT DOCUMENTS

| | | |
|---|---|---|
| JP | 58-39947 | 3/1983 |
| JP | 62-21098 | 5/1987 |
| JP | 02-020743 | 1/1988 |
| JP | 63-101603 | 7/1988 |
| JP | 4-19121 | 4/1992 |
| JP | 5-3402 | 1/1993 |
| JP | 5-57110 | 7/1993 |
| JP | 5-57111 | 7/1993 |
| JP | 06-146427 | 5/1994 |
| JP | 7-229204 | 8/1995 |
| JP | 11-153194 | 6/1999 |

OTHER PUBLICATIONS

*Seismic Rehabilitation Of A Four–Storey Building With A Stiffened Bracing System,* 8[th] Canadian Conference On Earthquake Engineering, Jan. 19, 1999, R. Tremblay et al.

* cited by examiner

*Primary Examiner*—Carl D. Friedman
*Assistant Examiner*—Chi Q Nguyen
(74) *Attorney, Agent, or Firm*—Kenyon & Kenyon

(57) ABSTRACT

The present invention relates to a buckling restrained brace capable of absorbing vibration energy produced by an earthquake, wind power and the like, in a building and a steel structure.

The buckling restrained brace of the present invention is accomplished by a buckling restrained brace 1 wherein a steel-made center axial member 3 is passed through a buckling-constraining concrete member 2 reinforced with a steel member 6, and an adhesion-preventive film 4 is provided to the interface between the steel-made center axial member and buckling-constraining concrete 5, the adhesion-preventive film showing a secant modulus in the thickness direction of at least 0.1 N/mm$^2$ between a point which shows a compressive strain of 0% and a point which shows a compressive strain of 50%, and up to 21,000 N/mm$^2$ between a point which shows a compressive strain of 50% and a point which shows a compressive strain of 75%, and having a thickness $d_t$ in the plate thickness direction of the steel-made center axial member and a thickness $d_w$ in the plate width direction thereof from at least 0.5 to 10% of the plate thickness t and from at least 0.5 to 10% of the plate width w, respectively, and by the application of the buckling restrained brace to a damping steel structure.

16 Claims, 22 Drawing Sheets

1
2
5
6
3
7
X
X
3
27
26
23
21
22

L=3700mm, W=250mm, t=36mm,
$e_0$=0.37m
$d_t/t$=1.4%(d=0.5mm)
$d_t/t$=11.1%(d=4.0mm)

BUCKLING RESTRAINED BRACES AND DAMPING STEEL STRUCTURES

CROSS REFERENCE TO RELATED APPLICATION

This application is a continuation-in-part application of Ser. No. 09/511,207 filed on Feb. 23, 2000 now abandoned.

BACKGROUND OF THE INVENTION

1. Field of the Invention

The present invention relates to buckling restrained braces used in buildings and steel structures and capable of absorbing vibration energy generated by an earthquake, wind power, etc.

2. Description of the Related Art

Japanese Examined Utility Model (Kokoku) No. 4-19121 discloses a buckling-constraining brace member in which an adhesion-preventive film is provided between a center axial member and a concrete member. Japanese Unexamined Utility Model (Kokai) No. 5-3402 discloses a buckling-constraining brace member wherein a steel-made center axial member is passed through a steel-made buckling-constraining member, and an adhesion-preventive film is placed between the surface of the center axial member and the buckling-constraining member. Japanese Unexamined Utility Model (Kokai) No. 5-57110 discloses a damping brace member wherein both ends of an intermediate member having a small cross section are each connectively and integrally jointed to one end of a side member having a large cross section, in series to form a steel-made center axial member, and the axial member is fitted in a constituent hollow buckling-constraining member. Japanese Unexamined Utility Model (Kokai) No. 5-57111 discloses a damping brace member having the same constitution as in Japanese Unexamined Utility Model (Kokai) No. 5-57110 and excellent in damping properties, durability and weatherability. Japanese Unexamined Patent Publication (Kokai) No. 7-229204 discloses that the stiffness and yield stress of a buckling-constraining brace member can be arbitrarily determined, and that the stress flow of the steel-made center axial member is improved. R. Tremblay et al. reported experimental result relate to buckling-constraining members in the 8th Canadian conference on Earthquake Engineering (cf. Seismic Rehabilitation of a Four-stored Building with a Stiffened Bracing System, published on, Jan. 19, 1999).

SUMMARY OF THE INVENTION

An adhesion-preventive film is provided between a buckling-constraining concrete member reinforced with a steel material and a steel-made center axial member for the purpose of preventing the steel-made center axial member from adhering to the concrete of the buckling-constraining concrete member. The following problems, about the adhesion-preventive film, arise. When the adhesion-preventive film is too thin, the film does not tolerate the expansion in the plate thickness direction of the steel-made center axial member caused by its axial deformation; on the other hand, when the adhesion-preventive film is too thick, it is incapable of constraining local buckling of the steel-made center axial member. Moreover the adhesion-preventive film has still other problems as mentioned below. When the stiffness in the thickness direction of the adhesion-preventive film is too low, it is incapable of maintaining a predetermined thickness due to the concrete pressure during pouring concrete; moreover, when the stiffness in the thickness direction thereof is too high, it cannot absorb the expansion in the plate thickness direction of the steel-made center axial member caused by the influence of Poisson's ratio at the time of plasticization, namely, plastic deformation of the steel-made center axial member.

When a plain steel (yield stress $\sigma_y$=235 N/mm$^2$) is used for the steel-made center axial member of a buckling restrained brace, there arises a problem that the buckling restrained brace cannot be made to function as a hysteresis damper against an earthquake of a small magnitude because the steel-made center axial member does not yield at the early stage against a ground motion acceleration (80 to 100 gal) of the earthquake.

A steel-made center axial member of a buckling restrained brace having the same cross-sectional area from one end of the member, through the central portion, to the other end has the following problem. When the steel-made center axial member is made to function as a hysteresis damper, both ends as well as the central portion of the member are plasticized (plastically deformed) due to yielding, and consequently fracture at joints between the buckling restrained brace and a steel structure including a column and a beam takes place.

In the process of producing a buckling-constraining concrete member of a buckling restrained brace reinforced with a steel material, when the ends of the reinforcing steel material of a buckling-constraining concrete member are open, there arise problems as mentioned below. During pouring the concrete, the concrete flows out before its solidification, and pouring concrete becomes difficult; cracked concrete falls during the use of the buckling restrained brace. Furthermore, an adhesion-preventive film is placed between the buckling-constraining concrete member of the buckling restrained brace reinforced with the steel material and the steel-made center axial member for the purpose of preventing mutual adhesion between the axial member and the concrete member. Accordingly, the following problem arises. When the steel-made center axial member is axially deformed due to vibration generated by an earthquake or wind power, it is not definite in which of two directions, a direction towards one end of the steel-made center axial member and a direction towards the other end thereof, the buckling-constraining concrete member is moved, and the concrete member is deflected to one of the two ends when the concrete member starts to be moved.

When the buckling restrained brace is to be mounted on a damping steel structure, the buckling restrained brace is generally jointed with high tensile bolts. In jointing the buckling restrained brace, the following problem arises. When the axial tension of the steel-made center axial member increases, the number of bolts used significantly increases, and the buckling restrained brace cannot be fixing jointed unless both of its ends are extremely expanded. Moreover, the width of both ends of the buckling restrained brace cannot be increased much because the width is restricted by the widths of columns and beams of the damping steel structure on which the buckling restrained brace is to be mounted.

The buckling restrained brace has a problem that the steel-made center axial member cannot be made to function as a hysteresis damper for absorbing vibration energy of the micro-vibration of an earthquake of very small magnitude, wind power, etc., to which the steel-made center axial member does not yield.

When the steel structure is shaken by an earthquake of a large magnitude, part of the columns, beams and braces of the steel structure are plasticized. Even when they are plasticized, the steel structure does not collapse so long as they have a sufficient capacity of plastic deformation and sufficient resistant to fatigue. However, jointed portions and welded portions prepared by field fabrication tend to decline in quality compared with those prepared by factory production, and are sometimes fractured before performing a sufficient plastic deformation function. When these columns, beams and braces are plasticized, the steel structure is deformed, and there arises a problem that the steel structure must be repaired on a large scale if it is to be used after the earthquake.

The problems mentioned above are solved by a buckling restrained brace 1 according to the present invention wherein a steel-made center axial member 3 is passed through a buckling-constraining concrete member 2 reinforced with a steel member 6, and an adhesion-preventive film 4 is provided to the interface between the steel-made center axial member and buckling-constraining concrete 5, the adhesion-preventive film showing a secant modulus in the thickness direction of at least 0.1 $N/mm^2$ between a point which shows a compressive strain of 0% and a point which shows a compressive strain of 50%, and up to 21,000 $N/mm^2$ between a point which shows a compressive strain of 50% and a point which shows a compressive strain of 75%, and having a thickness $d_t$ in the plate thickness direction of the steel-made center axial member 3 and a thickness $d_w$ in the plate width direction thereof from at least 0.5 to 10% of the plate thickness t and from at least 0.5 to 10% of the plate width w, respectively.

When considering pressure for placing concrete 5 in manufacturing a buckling-restraining brace 1, a desirable minimum thickness ratio of the adhesion-preventive film 4 and a steel-made center axial member 3 is preferably in the range from not less than 1.2% to up to 10%.

Moreover, in the buckling restrained brace according to the present invention, the steel-made center axial member 3 is a steel material showing a 0.2% proof stress or a yield point stress of up to 130 $N/mm^2$.

Furthermore, in the buckling restrained brace according to the present invention, the steel-made center axial member 3 is a steel material showing a 0.2% proof stress or a yield point stress of 130 to 245 $N/mm^2$.

Still furthermore, in the buckling restrained brace according to the present invention, the steel-made center axial member 3 has a minimum cross-sectional area in a central portion 21 in the longitudinal direction having a restricted length ratio which is the ratio of the length of the central portion to the whole length, and the steel-made center axial member has a cross-sectional area larger than the minimum cross-sectional area of the central portion 21 in the longitudinal direction, at both ends 22, 23 in the longitudinal direction connectively provided to the central portion in the longitudinal direction.

Moreover, in the buckling restrained brace 1 having a cross-sectional area of the central portion (21) as described in the above, the steel-made center axial member (3) shows an axial equivalent stiffness of at least 1.5 times that of the steel-made center axial member (3) which has same-sectional area from one end to the other end, passing through the central portion (21) in the length direction of said member (3).

Furthermore, in the buckling restrained brace according to the present invention, each of the cross-sectional areas 22-1, 23-1 at both ends 22, 23 in the longitudinal direction of the steel-made center axial member 3 which is obtained by subtracting a through hole-formed deficient area of the corresponding through holes for bolt insertion passing is at least 1.2 times the cross-sectional area 21-1 of the central portion 21 in the longitudinal direction of the steel-made center axial member.

Moreover, in the buckling restrained brace 1 according to the present invention, the steel member 6 is a reinforcing bar 6-1.

Still furthermore, in the buckling restrained brace 1 according to the present invention, a lid 24 is fixed to at least one end of the buckling-constraining concrete member 2.

Moreover, in the buckling restrained brace according to the present invention, a slip stopper 25 is provided to the center of the steel-made center axial member 3.

Furthermore, in the buckling restrained brace 1 according to the present invention, the buckling restrained brace 1 having the steel-made center axial member 3 which is provided with through holes 26 for bolt insertion at both ends 22, 23, and steel-made connecting plates 27 are friction jointed with high tension bolts by clamping, while the friction face sides at both ends 22, 23 of the steel-made center axial member which are contacted with the respective friction face sides of the steel-made connecting plates 27 or the friction face sides of the steel-made connecting plates 27 which are contacted with the respective friction face sides at both ends 22, 23 of the steel-made center axial member are made to have a higher surface hardness and a higher surface roughness than the counterpart friction face sides.

Still furthermore, in the buckling restrained brace according to the present invention, at least one set, comprising three layers which are formed from a C-shaped cross-sectional inside steel plate 29, a visco-elastic sheet 30 and a C-shaped cross-sectional outside steel plate 31, is fastened to each of the sides of the buckling-constraining concrete member 2 of the buckling restrained brace 1; one end 32 of the C-shaped cross-sectional inside steel plate 29 is fastened to one end 34 of the buckling restrained brace 1; and the other end 33 of the C-shaped cross-sectional outside steel plate 31 is fastened to the other end 35 of the buckling restrained brace 1 in the direction opposite to the one end 32 of the C-shaped cross-sectional outside steel plate 29.

Still furthermore, the problems mentioned above are solved by a damping steel structure 38 according to the present invention wherein the above-mentioned buckling restrained braces 1 according to the present invention are placed in the damping steel structure 38 which is formed with columns 36 and beams 37 prepared from a steel material showing a yield point stress higher than that of the steel-made center axial members 3 of the buckling restrained braces 1, the buckling restrained braces 1 showing both elastic and plastic behavior when the damping steel structure 38 vibrates under vibration action, and the steel structure 38 which is formed with the columns and the beams, showing elastic behavior.

BRIEF DESCRIPTION OF THE DRAWINGS

FIG. 1 (*b*) is a cross section taken along the line X—X in FIG. 1 (*a*).

FIG. 2 (*b*) is a schematic view of a strain ($\epsilon$)-stress ($\sigma$) hysteresis loop in a fatigue cyclic test.

FIG. 3 (*b*) shows horizontal deformation and story drift angles of the building.

FIG. 4 (*b*) is a cross section taken along the line X—X in FIG. 4 (*a*).

FIG. 4 (*c*) is a cross section taken along the line Y—Y in FIG. 4 (*a*).

FIG. 5 (*b*) is a cross section taken along the line X—X in FIG. 5 (*a*).

FIG. 5 (*c*) is a cross section taken along the line Y—Y in FIG. 5 (*a*).

FIG. 6 (*b*) is an enlarged view of the portion indicated by Y in FIG. 6 (*a*).

FIG. 6 (*c*) is a plan view of a buckling restrained brace of the present invention in which the cross-sectional area of the center portion of the steel-made center axial member is reduced.

FIG. 7 (*b*) is a cross section taken along the line X—X in FIG. 7 (*a*).

FIG. 7 (*c*) is a cross section taken along the line Y—Y in FIG. 7 (*a*).

FIG. 8 (*b*) is a cross section taken along the line X—X in FIG. 8 (*a*).

FIG. 8 (*c*) is a cross section taken along the line Y—Y in FIG. 8 (*a*).

FIG. 10 (*b*) is cross section taken along the x—x in FIG. 10 (*a*).

FIG. 11 (*b*) is cross section taken along the x—x in FIG. 11 (*a*).

FIG. 12 (*b*) is a cross section taken along the line X—X in FIG. 12 (*a*).

FIG. 13 (*b*) is a cross section taken along the line X—X in FIG. 13 (*a*).

FIG. 14 (*b*) is a cross section taken along the line X—X in FIG. 14 (*a*).

FIG. 15 (*b*) is a cross section taken along the line X—X in FIG. 15 (*a*).

FIG. 16 (*b*) is a cross section taken along the line X—X in FIG. 16 (*a*).

FIG. 17 (*b*) is a cross section taken along the line X—X in FIG. 17 (*a*).

FIG. 18 (*b*) is a cross section taken along the line X—X in FIG. 18 (*a*).

FIG. 19 (*b*) is an enlarged view of the portion indicated by Y in FIG. 19 (*a*).

FIG. 20 (*b*) shows an analytical model for nonlinear analyzing a buckling restrained brace.

FIG. 20 (*c*) is a schematic view of a steel center axial member.

FIG. 21 (*b*) shows the relationship when the adhesion-preventive film ratio $d_t/t$ is 11.1%.

FIG. 22 (*b*) shows an enlarged view of a protrusion.

FIG. 23 (*b*) shows an enlarged view of a protrusion.

DESCRIPTION OF PREFERRED EMBODIMENTS

Figure 2B:
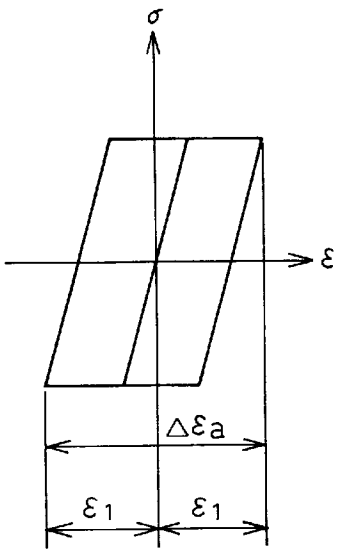
FIG. 2 (*a*) is a fatigue curve of the buckling restrained brace of the present invention.
Figure 2A:
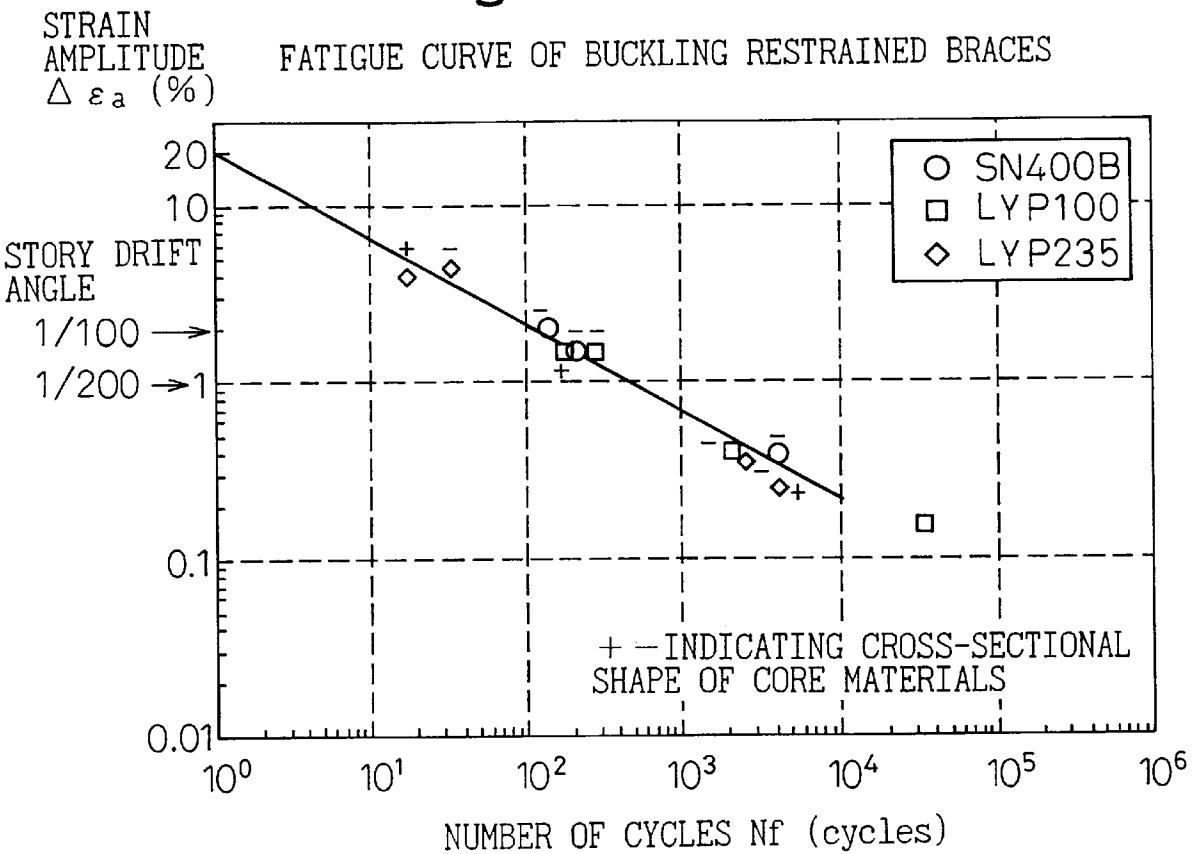

The present inventors have elucidated that, when a building shaken by an earthquake of a large magnitude shows, for example, story drift angle of 1/100 (refer to FIGS. 2 (*a*) and 2 (*b*)) and the estimated maximum axial strain of the steel-made center axial member is $\epsilon_1$=1% ($\epsilon_1 = \Delta\epsilon_a/2$), the steel-made center axial member is permitted to show axial plastic deformation and is prevented from being locally buckled by determining the ratio of a thickness of the adhesion-preventive film to a plate thickness of the steel-made center axial member, namely, the adhesion-preventive film ratio to be at least 0.5%, and have further determined that the adhesion-preventive film ratio must be up to 10% for the purpose of constraining local buckling thereof.

Figure 1A:
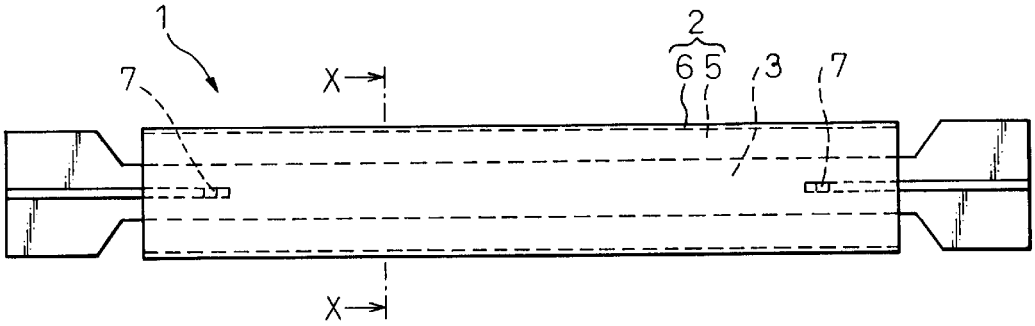
FIG. 1 (*a*) is a plane view of the buckling restrained brace of the present invention.
Figure 1B:
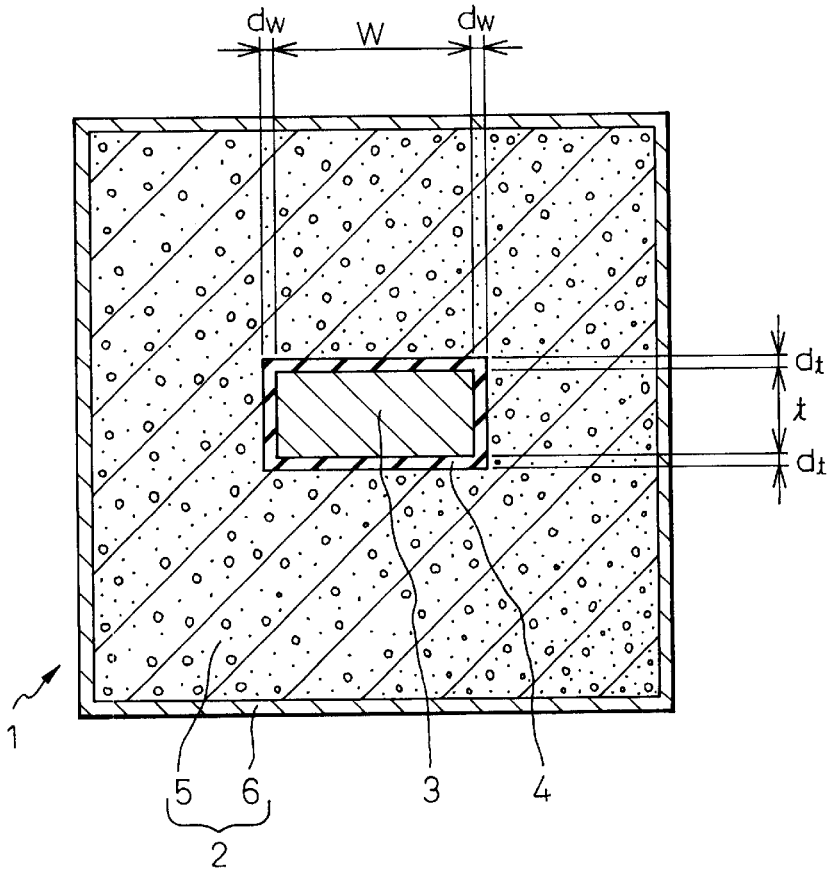

The adhesion-preventive film ratio can be obtained by the following procedure. The minimum value of the adhesion-preventive film ratio is obtained from the condition under which the steel-made center axial member is not contacted with the buckling-constraining concrete member surrounding the periphery thereof when the steel-made center axial member shows Poisson's ratio-based deformation in the plate thickness direction caused by its deformation in the axial direction. For a buckling restrained brace 1 shown in FIG. 1 (*a*) and FIG. 1 (*b*), when the axial strain $\epsilon_1$ of a steel-made center axial member 3 is 1.0% and the Poisson's ratio is 0.5 during plastic deformation, the strain $\epsilon_z$ in the plate thickness direction in the plastic deformation portion of the steel-made center axial member 3 can be obtained by the formula $$\epsilon_z = V\epsilon_1 = 0.5\times 1.0\% = 0.5\% \quad (1)$$

Accordingly, an approximate minimum ratio of a film thickness $d_t$ of an adhesion-preventive film 4 to a plate thickness t of the steel-made center axial member should be given by the formula $$d_t/t = s\epsilon_z/2 = 2\times 0.5\%/2 = 0.5\%$$

wherein s is a safety factor which is assumed to be 2.

When placing the concrete 5 of a buckling-constraining member 2, it is considered that the pressure on the concrete 5 is applied to an adhesion-preventive film 4 and this film is pressed by the pressure in the thickness direction of the film. Therefore, before placing the concrete 5, a preferable minimum thickness ratio $d_{t(min)}/t$ of the adhesion-preventive film 4 and a steel-made center axial member 3 must be at least about 1.2% of a plate thickness t (or width w) of the steel-made center axial member. This preferable minimum thickness ratio $d_{t\ (min)}/t$ before placing the concrete 5 can be obtained from following equation A. The following equation A is based on the condition that, during placing the concrete, compressive strain $\epsilon_z$ in the thickness direction of the adhesion-preventive film is estimated to be about 50%, and that, after placed the concrete, the adhesion-preventive film is maintained at the thickness after it is compressed by the strain $\epsilon_z$. When, after placed the concrete, the preferable thickness ratio $d_{t(min)}/t$ is defined to be not less than 0.5%, this preferable minimum thickness ratio $d_{t\ (min)}/t$ is $$d_t/t = \{[d_{t(min)} - (\mu \cdot V)]/t\}\cdot 100 = 0.5\% \quad (2)$$

Wherein $d_{t(min)}$ is the preferable minimum thickness of adhesion-preventive film, t is the plate thickness of the steel-made center axial member, V is a compressive deformed value of the film after the concrete 5 is placed in the reinforcing steel member 6, and $\mu$ is an additional safety factor for deformation.

When at least V=0.5 $d_{t(min)}$ and $\mu$=1.2, therefore, $$\{[d_{t(min)} - (1.2\times 0.5\ d_{t(min)})]/t\}\cdot 100 = 0.5\%$$

$$(0.4 d_{t(min)}/t)\times 100 = 0.5\%$$

$$(d_{t(min)}/t\times 100 = 1.25\%$$

Thus, before placing the concrete 5, the minimum thickness ratio $d_{t(min)}/t$ of the adhesion-preventive film 4 and a steel-made center axial member 3 is preferably at least about 1.2% of a plate thickness t or width w of the steel center axial member.

Figure 20A:
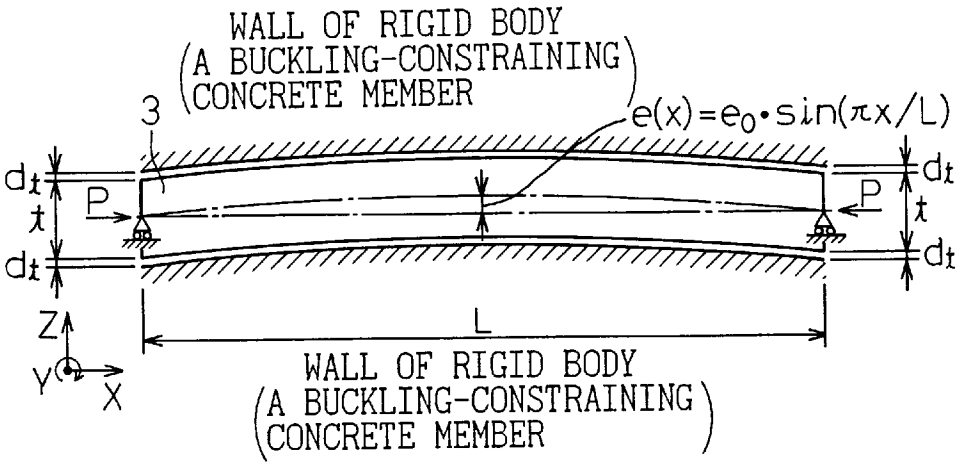
FIG. 20 (*a*) shows an analytical model for nonlinear analyzing a buckling restrained brace.
Figure 20B:
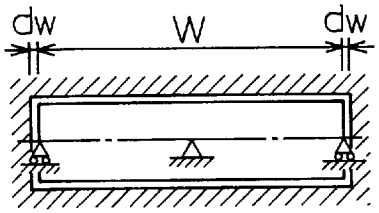
Figure 20C:
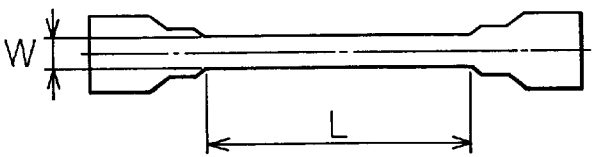

On the other hand, the maximum value of the adhesion-preventive film ratio can be obtained from the conditions under which the local buckling of the steel-made center axial member does not exert adverse effects on the relationship between a load and a deformation and the resistance to fatigue of the buckling restrained brace. Nonlinear analysis carried out on an analysis model shown in FIGS. 20 (*a*), 20 (*b*) and 20 (*c*), and FIGS. 21 (*a*) and 21 (*b*) shows the results of analyzing the relationship between a load and a deformation when the adhesion-preventive film ratio $d_t/t$ is 1.4% or 11.1%. The buckling restrained brace shows stabilized behavior in FIG. 21 (*a*), whereas it shows, in FIG. 21 (*b*), phenomena of a rapid decrease in the load in the course of increasing the displacement, that is, it shows unstabilized behavior. The unstabilized behavior is caused by local buckling of the steel-made center axial member within the buckling-constraining concrete member due to an excessive thickness of the adhesion-preventive film. In order to prevent local buckling of the steel-made center axial member 3, the adhesion-preventive film ratio should be up to 10%.

That is, the film thickness in the adhesion-preventive film ratio should be from at least 0.5 to 10% of the plate thickness of the steel-made center axial member.

Next, the secant modulus of the adhesion-preventive film 4 is defined for two reasons. A first reason will be explained below.

(1) The secant modulus is defined because the thickness required of the adhesion-preventive film can be sufficiently ensured after the buckling-constraining concrete member of a buckling restrained brace is prepared by pouring concrete.

During pouring concrete, the adhesion-preventive film is required to have such a rigidity, at the lowest point of the buckling restrained brace where the concrete pressure is highest, that the strain $\epsilon_z$ in the thickness direction is up to 50%. Consequently, the thickness of the adhesion-preventive film becomes half of the initial thickness at the lowest point of pouring concrete. However, the decrease is taken into consideration by setting the safety factor s at 2 in the calculation of a minimum value of the film, and a sufficient thickness of the adhesion-preventive film as a whole can be ensured. The rigidity (secant modulus) of the adhesion-preventive film is obtained by the following procedure. The pouring pressure p of the concrete of the buckling-constraining concrete member of the buckling restrained brace is obtained by the formula $$p = wh = 2.4\times 2 = 0.48\ tf/m^2 = 0.48\ kgf/cm^2 \quad (3)$$

wherein w is a unit volume weight of the concrete (which is assumed to be 2.4 $tf/m^3$), and h is a pouring height of the concrete (which is assumed to be 2 m). The rigidity of the film at the time when the strain $\epsilon_z$ in the thickness direction is 50% is obtained by the formula $$E_{min} = p/\epsilon_z = 0.48/0.5 \approx 1.0\ kgf/cm^2 \quad (4)$$

Therefore, the secant modulus in the thickness direction of the adhesion-preventive film between the highest concrete pouring point where the compressive strain (strain $\epsilon_z$ in the thickness direction) is 0% and the lowest concrete pouring point where the compressive strain is 50% is required to be at least 1.0 $kgf/cm^2$ (0.1 $N/mm^2$).

A second reason for defining the secant modulus of the adhesion-preventive film is explained below.

(2) The secant modulus is defined because the adhesion-preventive film thus defined is capable of sufficiently absorbing the expansion of the steel-made center axial member of the buckling restrained brace in the out-of-plane direction without buckling when the steel-made center axial member is plastically deformed.

The strain $\epsilon_z$ in the thickness direction of the adhesion-preventive film at the lowest concrete pouring point is 50%, and the maximum strain $\epsilon_z$ in the thickness direction thereof estimated from the decline of the building at the time of an earthquake is defined to be 75%. Moreover, in general, when the steel-made center axial member is plastically deformed by vibration generated by an earthquake or the like, the axial member is buckled if it is compression deformed, whereas the axial member is not buckled if it is tensile deformed. Therefore, between a point where the strain $\epsilon_z$ (compressive deformation alone being considered) in the thickness direction is 50% and a point where $\epsilon_z$ is 75%, the adhesion-preventive film is required to have a rigidity of such a degree that the film can absorb the expansion of the steel-made center axial member in the out-of-plane direction to prevent the axial member from being buckled when the axial member is plastically deformed. The adhesion-preventive film is required to have a secant modulus of up to the elastic coefficient of the buckling-constraining concrete member. That is, the secant modulus $E_{max}$ of the adhesion-preventive film is determined to be up to $2.1\times10^5$ kgf/cm$^2$ (21,000 N/mm$^2$) between a point where the strain $\epsilon_z$ in the thickness direction is 50% and a point where $\epsilon_z$ is 75%.

Figure 3A:
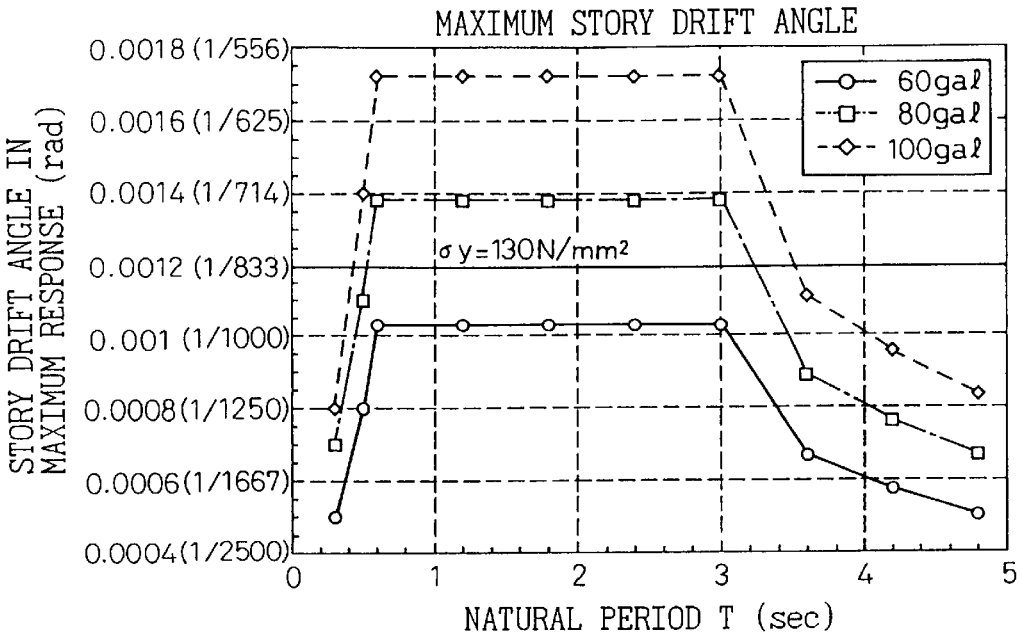
FIG. 3 (*a*) shows the relationship between a natural period T and a story drift angle (rad) at a maximum response of a building to which the buckling restrained brace of the present invention is attached.
Figure 3B:
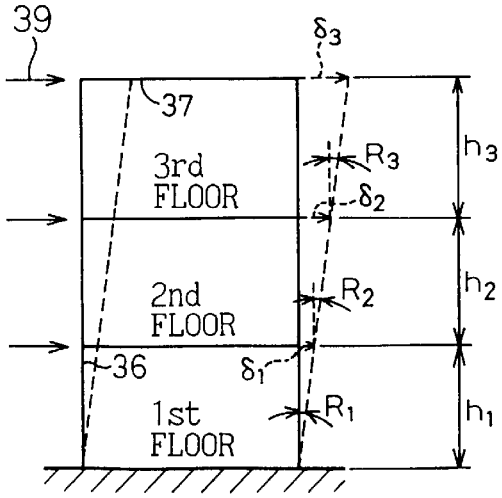

Next, in order to make the steel-made center axial member of a buckling restrained brace function as a hysteresis damper against an earthquake of a small magnitude, a steel material having a 0.2% proof stress or a yield point of up to 130 N/mm$^2$ is used therefore. As a result, even when a small earthquake showing a ground motion acceleration of 80 to 100 gal happens, the steel-made center axial member yields at an early stage, and the axial member can be made to function as a hysteresis damper as shown in FIGS. 3(*a*) and 3(*b*) exhibiting the relationship between a natural period T and a story drift angle rad at a maximum response. As shown in FIG. 3(*b*), a frame of a building including columns 36 and beams 37 shows horizontal deformation ($\delta_1$, $\delta_2$, $\delta_3$) when a horizontal force 39 acts on the building. The story drift angle at the horizontal deformation is expressed by the formulas $$R_1=\delta_1/h_1,\ R_2=\delta_2/h_2,\ R_3=\delta_3/h_3$$

wherein $R_1$, $R_2$ and $R_3$ are a story drift angle of the first floor, a story drift angle of the second floor and a story drift angle of the third floor, respectively.

Figure 4C:
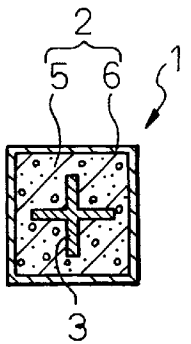
FIG. 4 (*a*) is a plan view of a buckling restrained brace of the present invention in which the cross-sectional area in the central portion of the steel-made center axial member is reduced.
Figure 4B:
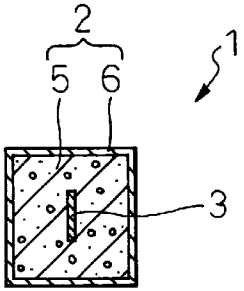
Figure 4A:
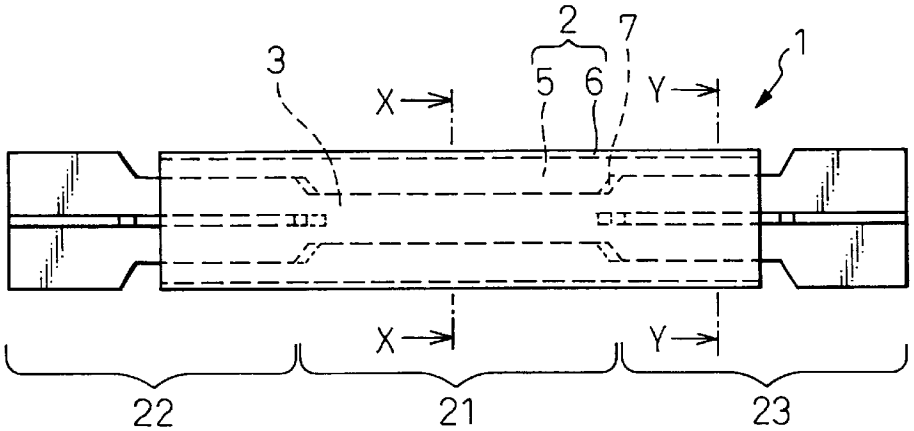
Figure 5C:
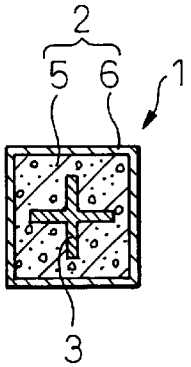
FIG. 5 (*a*) is a plan view of a buckling restrained brace of the present invention in which the cross-sectional area in the central portion of the steel-made center axial member is reduced.
Figure 5B:
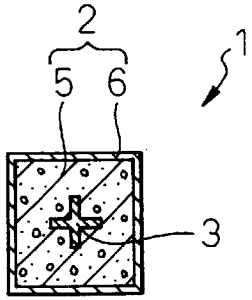
Figure 5A:
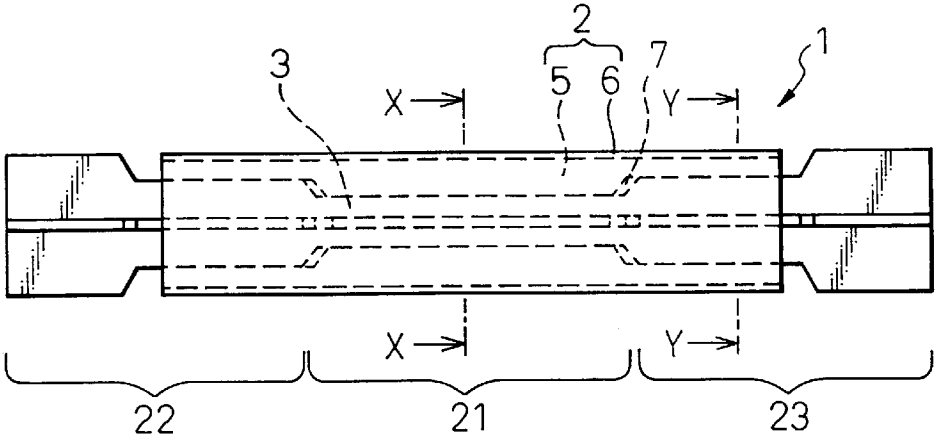

Furthermore, as shown in FIGS. 4 (*a*), 4 (*b*) and 4 (*c*) and FIGS. 5 (*a*), 5 (*b*) and 5 (*c*), the cross-sectional area of the steel-made center axial member 3 of a buckling restrained brace 1 is made minimum in a central portion 21 in the longitudinal direction having a ratio of its length to the whole length in a restricted range, and made larger at both ends 22, 23 connectively provided to the central portion 21 in the longitudinal direction than that in the central portion. As a result, the central portion 21 can be made to function as a hysteresis damper. Both ends 22, 23 of the member 3 can maintain an elastic state, and fracture of a jointed portion between the buckling restrained brace 1 and a steel structure including a column and a beam can be prevented.

Figure 6A:
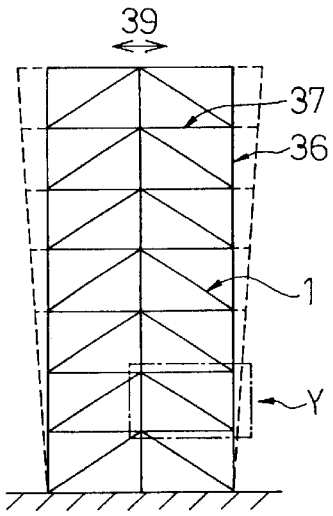
FIG. 6 (*a*) is a schematic view of a damping steel structure in which buckling restrained braces are placed in a steel structure having columns and beams.
Figure 6B:
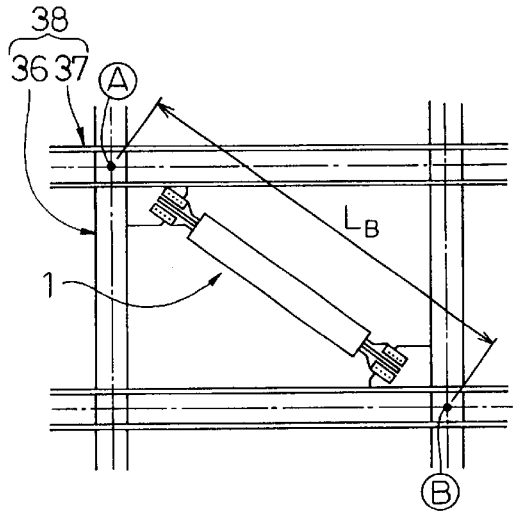
Figure 6C:
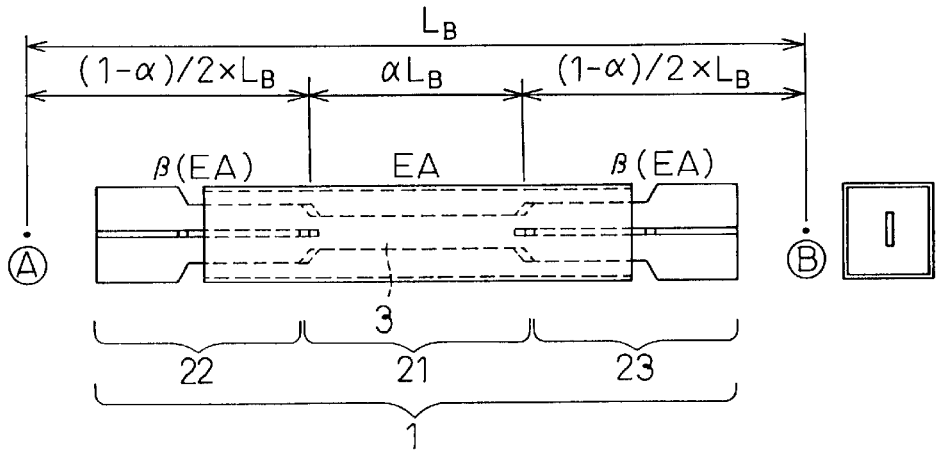

Furthermore, the present invention permits using a steel material having a yield point as high as 245 N/mm$^2$ for the steel-made center axial member 3 in the buckling restrained brace 1. As shown in FIGS. 6(*a*), 6(*b*) and 6(*c*), when the length $\alpha L_B$ of the central portion 21 in the longitudinal direction which has the minimum cross-sectional area in the steel-made center axial member 3 and a restricted ratio of its length to the whole length, and the length $(1-\alpha)L_B/2$ of both ends 22, 23 in the longitudinal direction which each have a cross-sectional area larger than that of the central portion are each varied to increase the axial equivalent stiffness of the steel-made center axial member 3, the steel-made center axial member 3 has same area from one end to the other end, passing through the central portion in the length direction of the steel center axial member 3, and can be made to show an axial equivalent stiffness 1.5 times as much as that of a steel-made center axial member having a uniform cross-sectional area and show an apparent yield point of up to 130 N/mm$^2$. For example, in buckling restrained brace 1 having three portion as shown in FIG. 6 (*c*), (the steel-made center axial member 3 of the buckling restrained brace is provided with the cross-sectional area A in the length $\alpha L_B$ of the central portion 21 in the longitudinal direction, and the cross-sectional area $\beta A$ in the length $(1-\alpha)L_B/2$ and has the axial equivalent stiffness $k_1$. Further, the steel-made center axial member 3 is provided with same area from one end to the other end, passing through the central portion in the length direction of the member 3 and has the axial equivalent stiffness $k_0$.) a buckling restrained brace 1 having three portions as shown in FIG. 6 (*c*) is made to have, at each of both ends 22, 23, a cross-sectional area 2.5 times that of the central portion (thus; $\beta$), the buckling restrained brace shows an axial stiffness 1.8 times that of a buckling restrained brace which is the same as the above-mentioned buckling restrained brace except that it has a uniform cross-sectional area, and an apparent yield point reduced by a factor of 1.8. That is, the axial stiffness of the buckling restrained brace having a uniform cross-sectional area is expressed by the formula $$k_0=EA/L_B \tag{5}$$

For example, when $\alpha$=0.25 and $\beta$=2.5, $$k_1=k_0/\{\alpha+(1-\alpha)\cdot1/\beta\}=k_0/\{0.25+(1-0.25)\cdot l/2.5\}=1.8k_0 \tag{6}$$

Therefore, when the buckling restrained brace (1) having 3 portions is made to have a cross-sectional area at both ends 2.5 times that in the central portion, it shows an axial stiffness 1.8 times that of the same buckling restrained brace except that it has a uniform cross-sectional area. Accordingly, the steel-made center axial member of the buckling restrained brace yields at displacement smaller by a factor of 1.8. As a result, even when a steel material having a yield point as high as 225 N/mm$^2$ is used therefor, since the apparent yield point of the buckling restrained brace is up to 130 N/mm$^2$, the buckling restrained brace satisfactorily functions as a hysteresis damper against an earthquake showing a ground motion acceleration as small as from 80 to 100 gal.

Figure 7A:
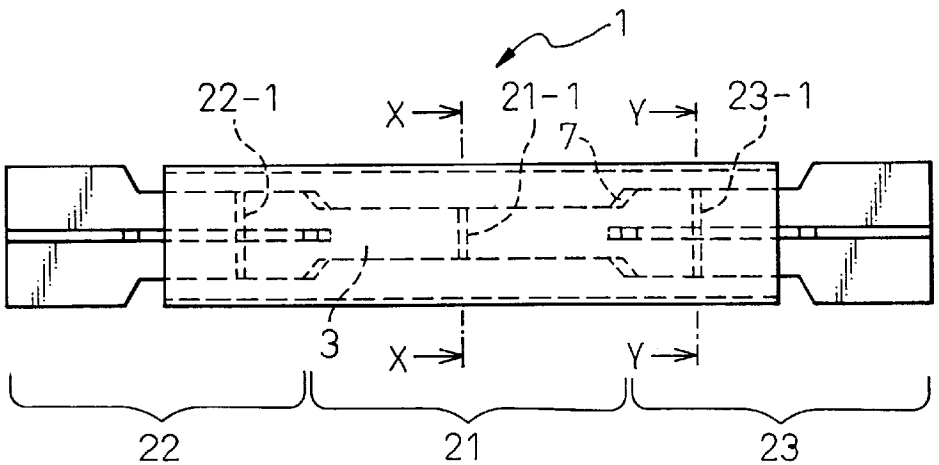
FIG. 7 (*a*) is a plan view of a buckling restrained brace of the present invention in which the cross-sectional area in the central portion of the steel-made center axial member is reduced.
Figure 7B:
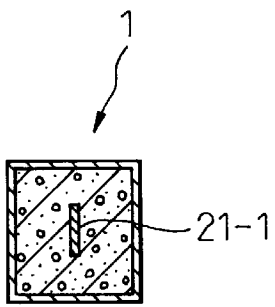
Figure 7C:
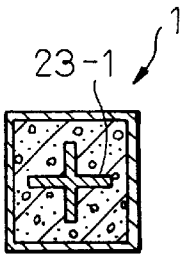
Figure 8A:
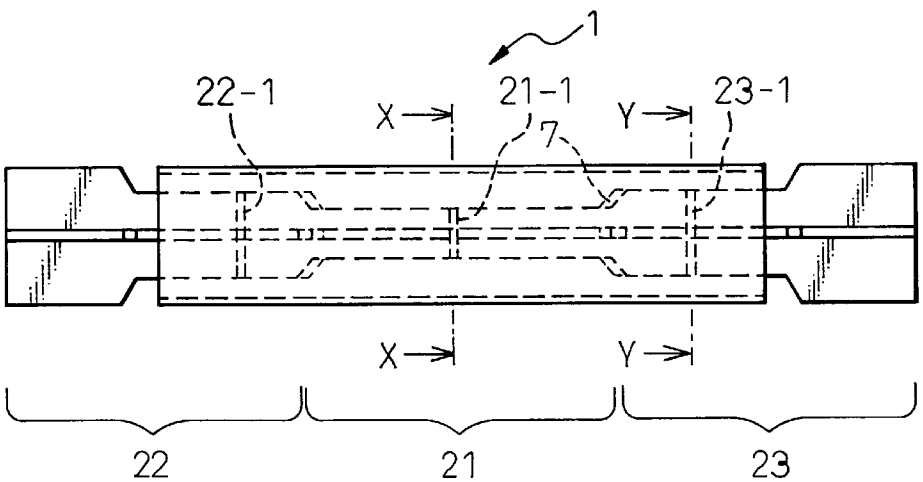
FIG. 8 (*a*) is a plan view of a buckling restrained brace of the present invention in which the cross-sectional area in the central portion of the steel-made center axial member is reduced.
Figure 8B:
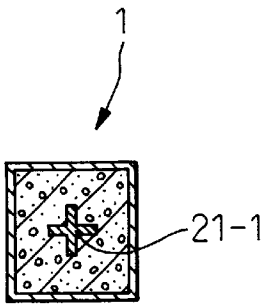
Figure 8C:
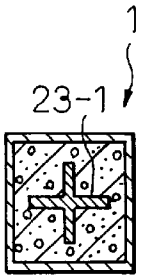
Figure 9:
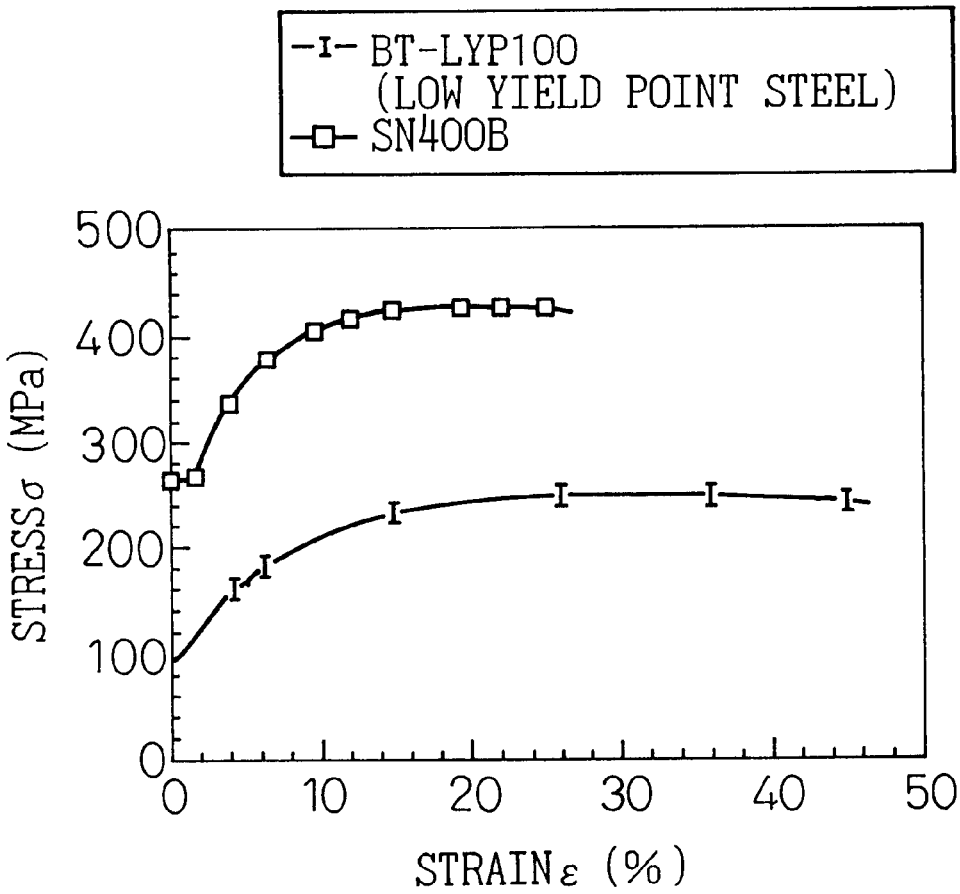
FIG. 9 shows a stress-strain curve of a steel used as a steel material of the steel-made center axial member of a buckling restrained brace of the present invention.

Furthermore, even when the cross section at both ends in the longitudinal direction of the steel-made center axial member of the buckling restrained brace is made larger than that in the central portion, an elastic state at both ends thereof cannot be maintained if the axial member is prepared from a steel material showing large strain hardening. When the steel material shows a strain hardening ratio (tensile strength/yield point) of at least 1.2 (shown in FIG. 9), the axial generated at the ends of the steel-made center axial member is expressed by the formula $$\text{axial force}\geqq\sigma_y\times1.2\,A$$

wherein $\sigma_y$ is the yield stress of the steel-made axial member, and A is the cross-sectional area in the central portion thereof as shown in FIGS. 7 (*a*), 7 (*b*) and 7 (*c*), and FIGS. 8 (*a*), 8 (*b*) and 8 (*c*). Therefore, plastic deformation at the ends of the steel-made center axial member can be avoided by making the cross-sectional area at the ends thereof at least 1.2 times that in the central portion.

Figure 10B:
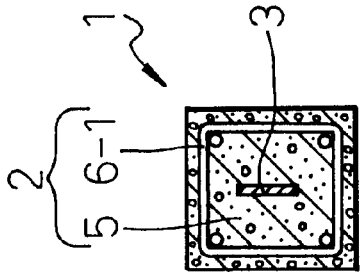
FIG. 10 (*a*) is a plain view of a buckling restrained brace which is used as a reinforcing bar for a steel member of a buckling-constraining concrete member.
Figure 10A:
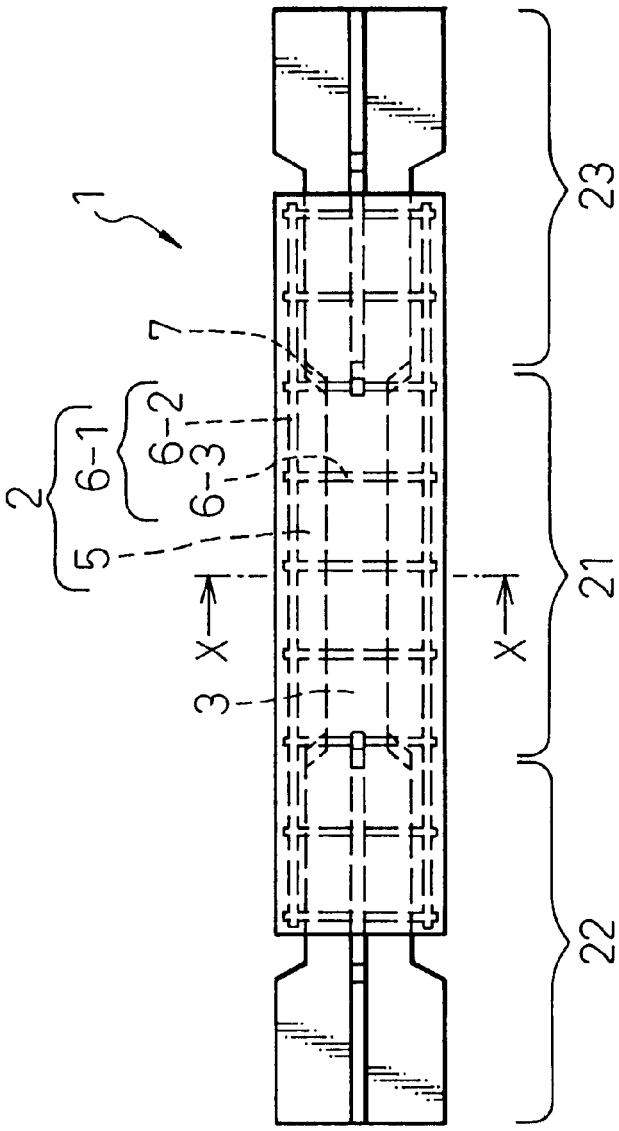
Figure 11B:
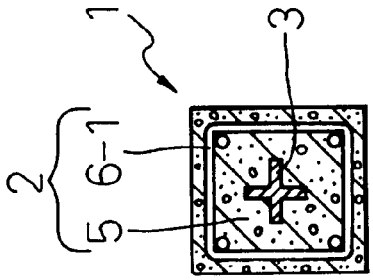
FIG. 11 (*a*) is a plain view of a buckling restrained brace which is used as a reinforcing bar for a steel member of a buckling-constraining concrete member.
Figure 11A:
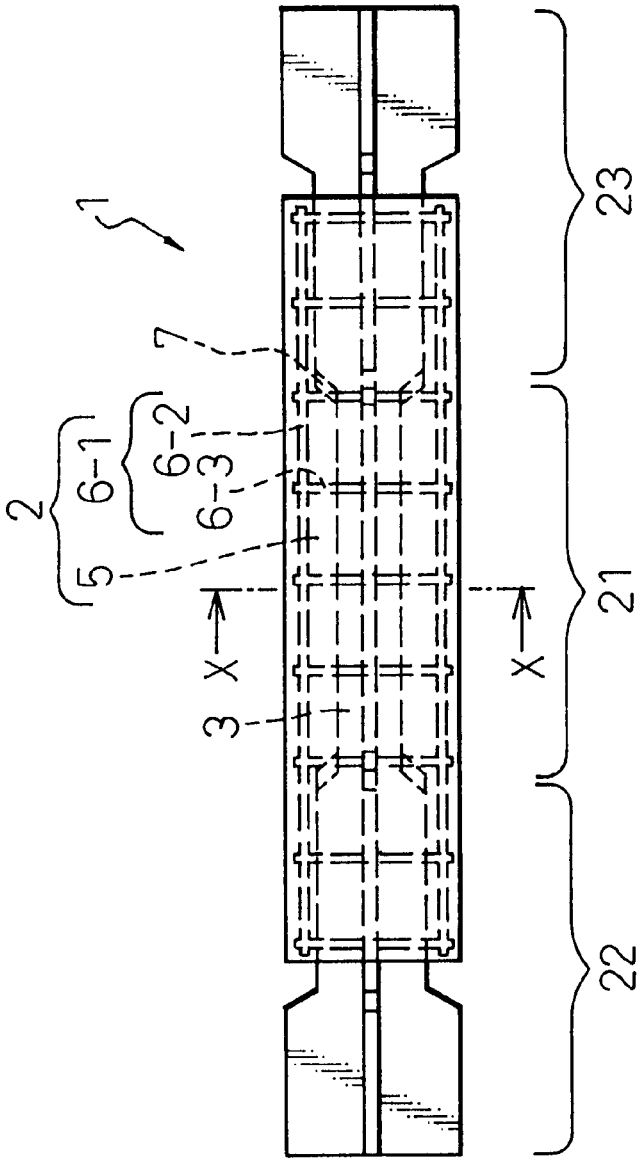

Furthermore, FIGS. 10 (*a*) and 10 (*b*), and FIGS. 11 (*a*) and 11 (*b*) show the examples in which a reinforcing bar 6-1 is used as a steel member of a buckling-constraining concrete member. Main reinforcements 6-2 are arranged along axial direction of a buckling restrained brace 1 and hoop reinforcements 6-3 are arranged in the radial direction of the brace 1. Thereby, bending stiffness and buckling effect of the buckling-constraining concrete member can be increased.

Furthermore, when the bending stiffness and the buckling effect of the buckling-constraining concrete member can be increased, a continuous or discontinuous shaped member such a continuously integrated steel member, a steel member having openings in its surface, a spiral steel member or the like can be used as a steel member of a buckling-constraining concrete member.

Figure 12B:
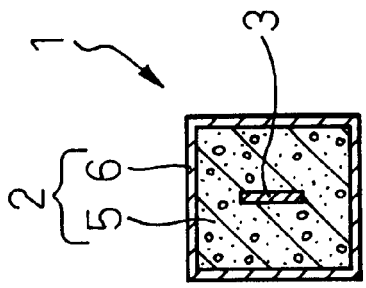
FIG. 12 (*a*) is a plan view of a buckling restrained brace of the present invention in which a lid is provided to one end of the buckling-constraining concrete member.
Figure 12A:
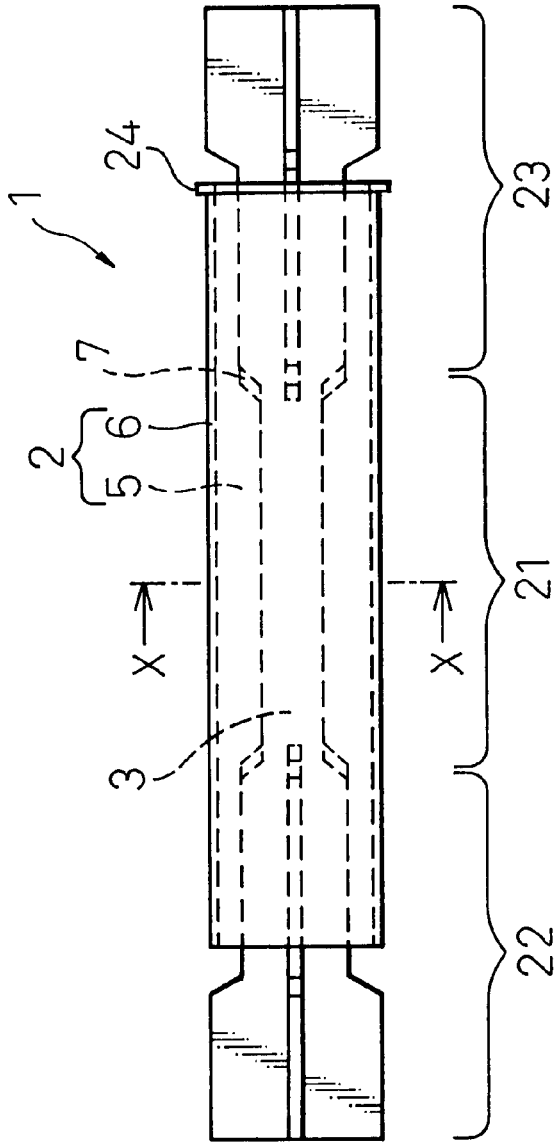
Figure 13B:
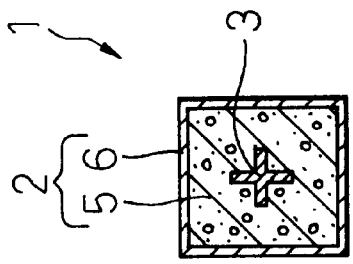
FIG. 13 (*a*) is a plan view of a buckling restrained brace of the present invention in which a lid is provided to one end of the buckling-constraining concrete member.
Figure 13A:
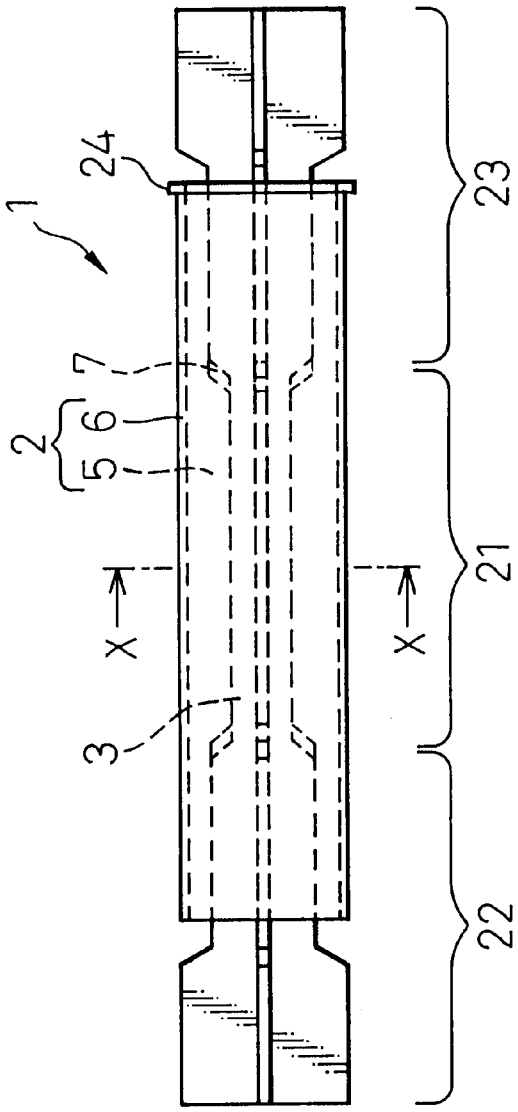
Figure 14B:
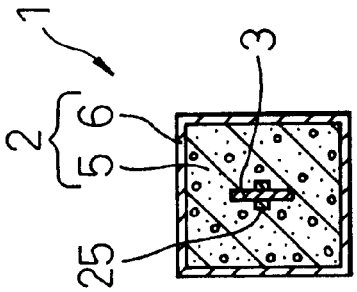
FIG. 14 (*a*) is a plan view of a buckling restrained brace of the present invention in which a slip stopper is provided to the central portion of the steel-made center axial member.
Figure 14A:
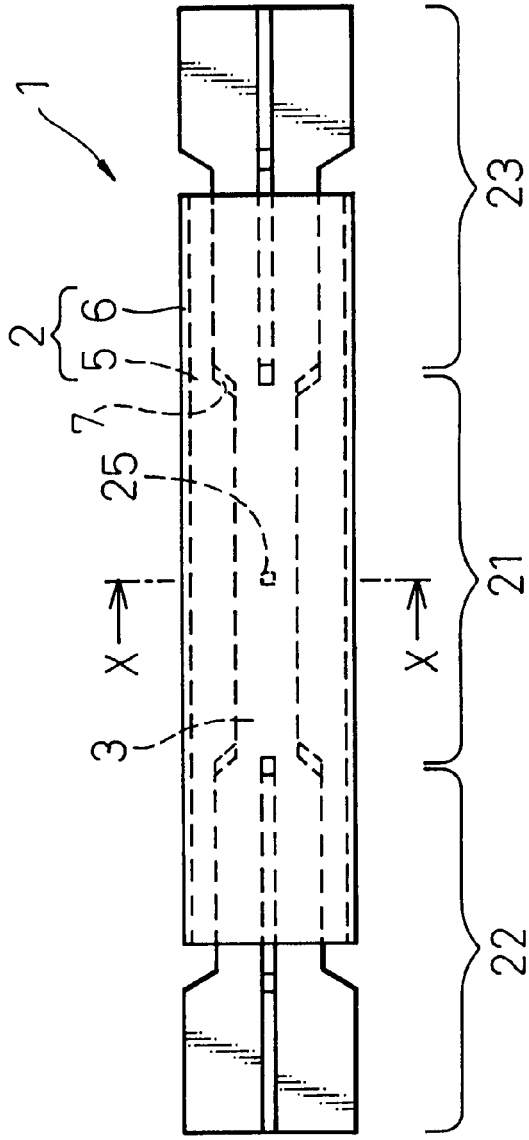
Figure 15B:
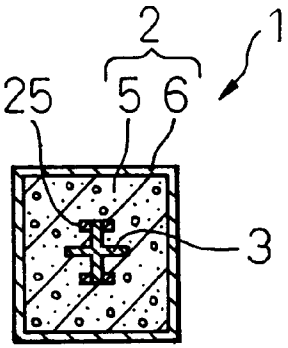
FIG. 15 (*a*) is a plan view of a buckling restrained brace of the present invention in which a slip stopper is provided to the central portion of the steel-made center axial member.
Figure 15A:
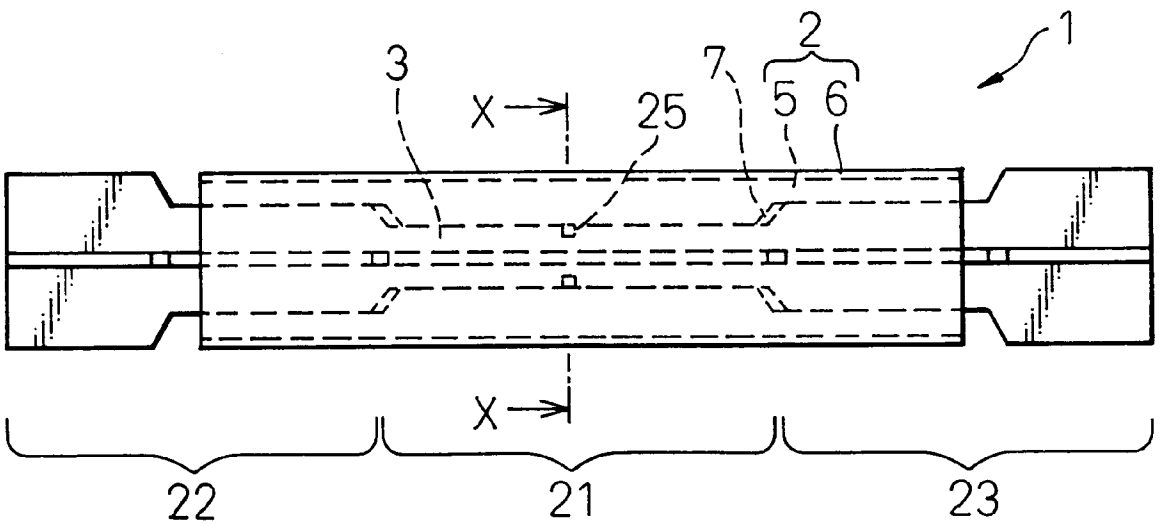

Moreover, the problem of properly pouring concrete for the buckling-constraining concrete member of a buckling restrained brace at a predetermined site can be solved by attaching a lid 24 at one end of the buckling-constraining concrete member 2 as shown in FIGS. 12 (*a*) and 12 (*b*) and FIGS. 13 (*a*) and 13 (*b*); the lid can prevent cracked concrete from falling. In order to prevent the movement of the buckling-constraining concrete member when the steel-made center axial member is axially deformed by vibration generated by an earthquake, wind power or the like, a slip stopper 25 in a protruded shape is provided thereto as shown in FIGS. 14(*a*) and 14(*b*) and FIGS. 15(*a*) and 15(*b*), whereby the buckling-constraining concrete member can be fixed to the central portion thereof when the steel-made center axial member is axially deformed.

Figure 21A:
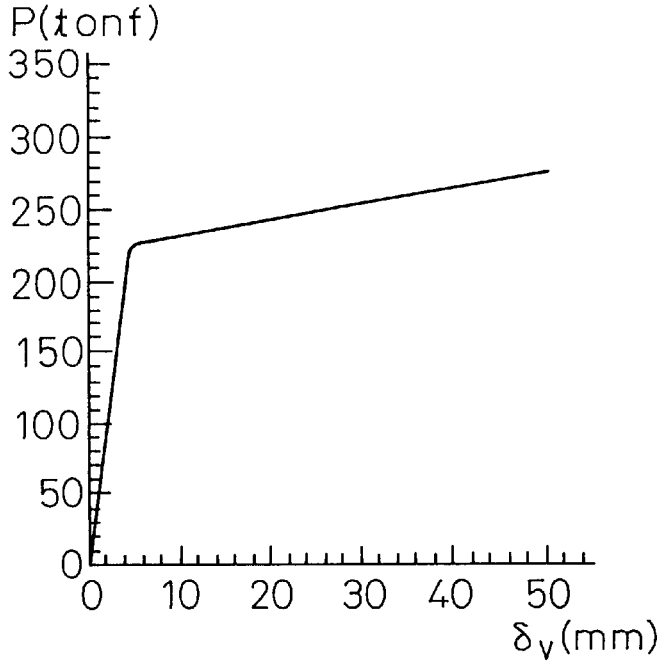
FIG. 21 (*a*) shows the relationship between an axial force and a displacement in the axial direction of a buckling restrained brace and shows the relationship when the adhesion-preventive film ratio $d_t/t$ is 1.4%.
Figure 21B:
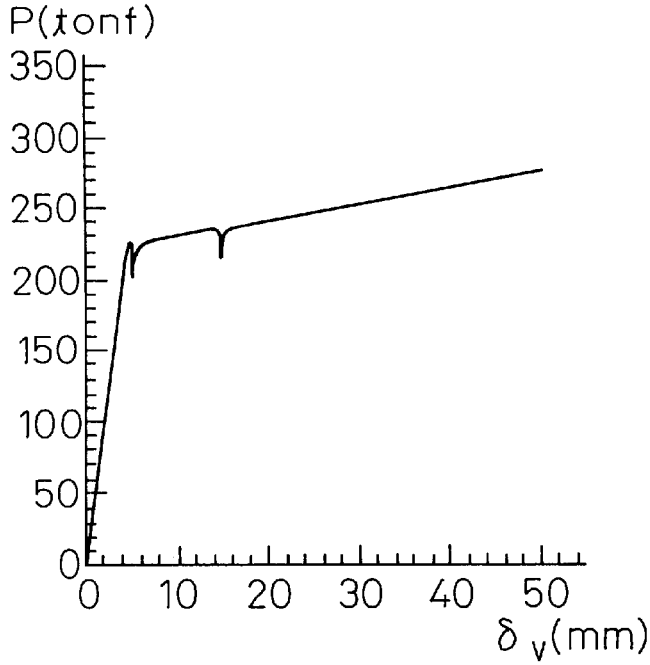
Figure 22A:
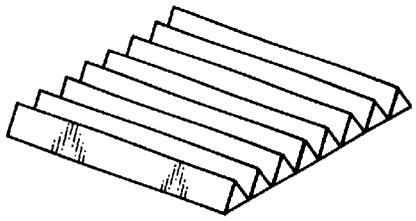
FIG. 22 (*a*) shows the shape of protrusions on a friction joint face.
Figure 22B:
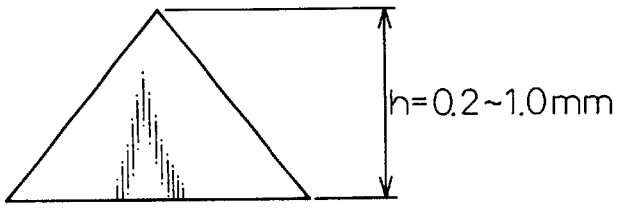

When the buckling restrained brace is to be fixing jointed to a damping steel structure with high tension bolts, as shown in FIGS. 22(*a*), and 22(*b*) and FIGS. 21(*a*) and 21(*b*), the surface hardness and surface roughness of the friction face sides of both ends 22, 23 of the steel-made center axial member, or the surface hardness and surface roughness of the corresponding steel-made connecting plates 27 are made larger than those of the counterpart friction face side. Since the friction joint proof strength of one high tension bolt is at least twice that of one high tension bolt in ordinary fixing jointing, the number of necessary bolts can be made half or less compared with that in ordinary fixing jointing, and the buckling restrained brace can be fixing jointed to the damping steel structure with the high tension bolts without extremely enlarging the width of both ends of the steel-made center axial member.

Figure 18B:
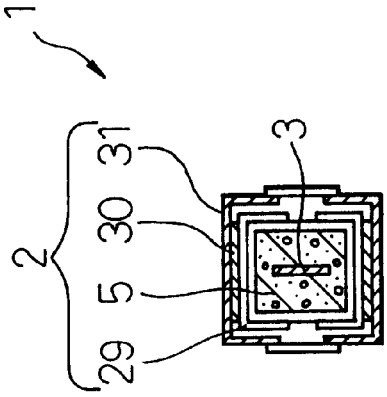
FIG. 18 (*a*) is a plan view of a buckling restrained brace of the present invention capable of coping with micro-vibration.
Figure 18A:
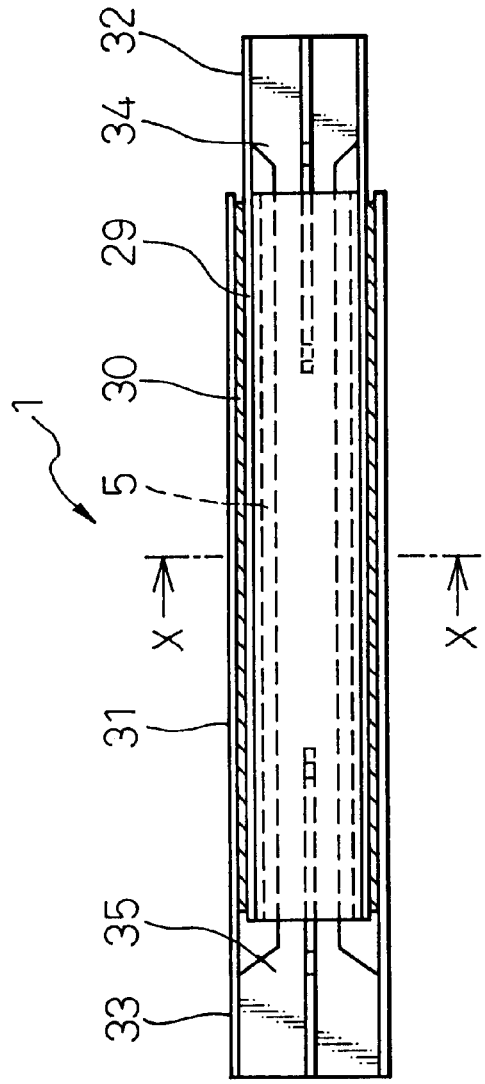

In order for the buckling restrained brace to absorb micro-vibration of a degree generated by an earthquake of a small magnitude, wind power or the like, that the steel-made center axial member of the buckling restrained brace does not yield, at least one set comprising three layers which are formed from a C-shaped cross-sectional inside steel plate 29, a visco-elastic sheet 30 and a C-shaped cross-sectional outside steel plate 31 is fastened to each of the two sides of the buckling-constraining concrete member 2 in the buckling restrained brace 1 as shown in FIGS. 18(*a*) and 18(*b*). As a result of making a combination of the buckling restrained brace 1 and the visco-elastic sheets, the visco-elastic sheets act against very micro-vibration of such a degree that the steel-made center axial member of the buckling restrained brace does not yield, and absorbs the vibration energy by their shear deformation. However, when the vibration generated by an earthquake of a relatively large magnitude and wind power act on the buckling restrained brace, the steel-made center axial member yields and functions as a hysteresis damper; the buckling restrained brace can obtain a capacity of absorbing the energy of vibration generated by the earthquake and wind power by the sum of an energy-absorbing capacity effected by plasticization plastic deformation of the steel-made center axial member and one effected by shear deformation of the visco-elastic sheets.

Figure 19B:
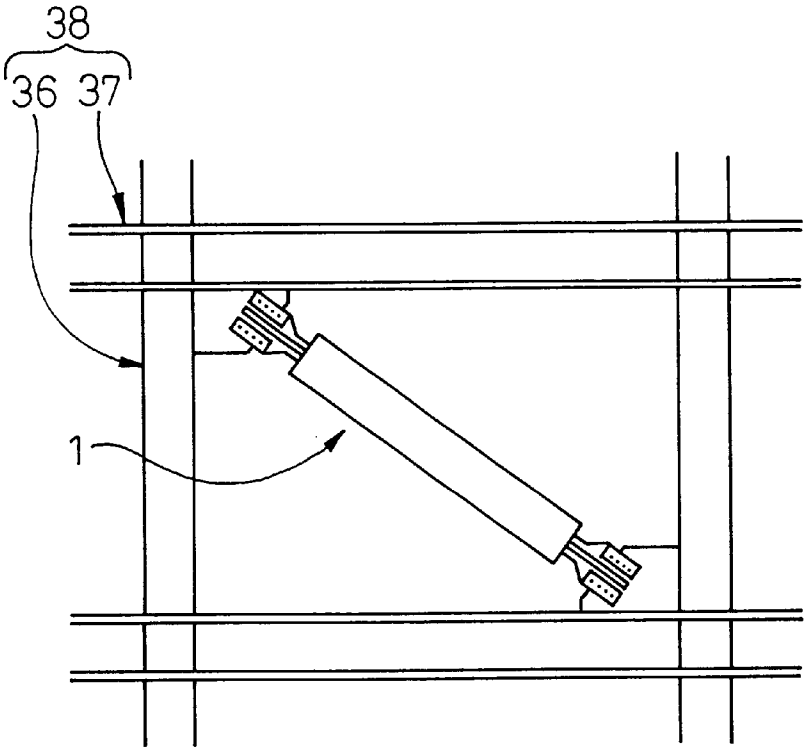
FIG. 19 (*a*) is a schematic view of a damping steel structure in which buckling restrained braces are placed in a steel structure having columns and beams.
Figure 19A:
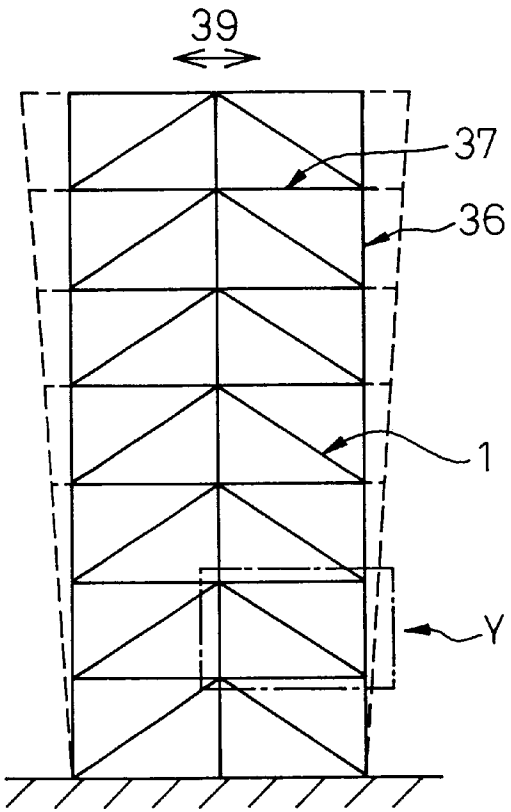

A steel structure and its building damping steel structure are designed as explained below. When an earthquake of a large magnitude acts on a steel structure 38 and its building in which buckling restrained braces 1 are used as braces as shown in FIGS. 19(*a*) and 19(*b*), the buckling restrained braces alone are plasticized, and the main structure of columns 36 and beams 37 of the steel structure and its building maintain an elastic state (damping steel structure) by plasticizing the buckling restrained braces 1 alone. Since the plastic deformation portions of the buckling restrained braces having a capacity of plastic deformation and resistance to fatigue which have been confirmed can thus be specified, the structural performance of the steel structure and its building become definite. Fracture of the buckling restrained braces and collapse of the building can therefore be avoided. Furthermore, the main structure is restored to the original position after the earthquake because the main structure is always in an elastic state, and exchange of the plasticized buckling restrained braces alone permits continued use of the steel structure and its building.

EXAMPLE 1

An adhesion-preventive film having a ratio (adhesion-preventive film ratio) of the film thickness to the plate thickness of a steel-made center axial member of at least 0.5 to 10% was provided between a buckling-constraining concrete member and the steel-made center axial member. When considering the pressure for placing concrete 5 in manufacturing a buckling-restraining brace 1, a lower limitation of a minimum thickness ratio $d_{t\ (min)}/t$ of the adhesion-preventive film 4 and a steel-made center axial member 3 is preferably about 1.2%. The adhesion-preventive film had a secant modulus in the thickness direction of at least 0.1 $N/mm^2$ between a point having a compressive strain of 0% and a point having a compressive strain of 50%, and up to 21,000 $N/mm^2$ between a point having a compressive strain of 50% and a point having a compressive strain of 75%. In the present example, a maximum axial strain amplitude $\Delta\epsilon_a$ of 4% was applied to a buckling restrained brace having an adhesive-preventive film ratio of 4% by a tension and compression tester. The steel-made center axial member then showed a tension and compression hysteresis loop as shown in FIG. 2(*b*), and was deformed due to yielding without buckling even on the compression stress side. It is quite natural that in most cases the decline of a building caused by an earthquake or wind power, namely, the axial strain amplitude $\Delta\epsilon_a$ of the steel-made center axial member is still lower. Accordingly, when the axial strain amplitude $\Delta\epsilon_a$ thereof is estimated to be a still lower one, the adhesion-preventive film ratio can be decreased. Although a butyl rubber was used as an adhesion-preventive film in the present example, any material can be used so long as the material is an elastic or visco-elastic one and has a secant modulus as defined in the present invention.

Concrete examples of the adhesion-preventive film material are plastics, natural rubber, polyisoprene, polybutadiene, styrene-butadiene rubber, ethylene-propylene rubber, polychloroprene, polyisobutylene, asphalt, paint and a mixture of these substances.

EXAMPLE 2

Figures 16A, 16B:
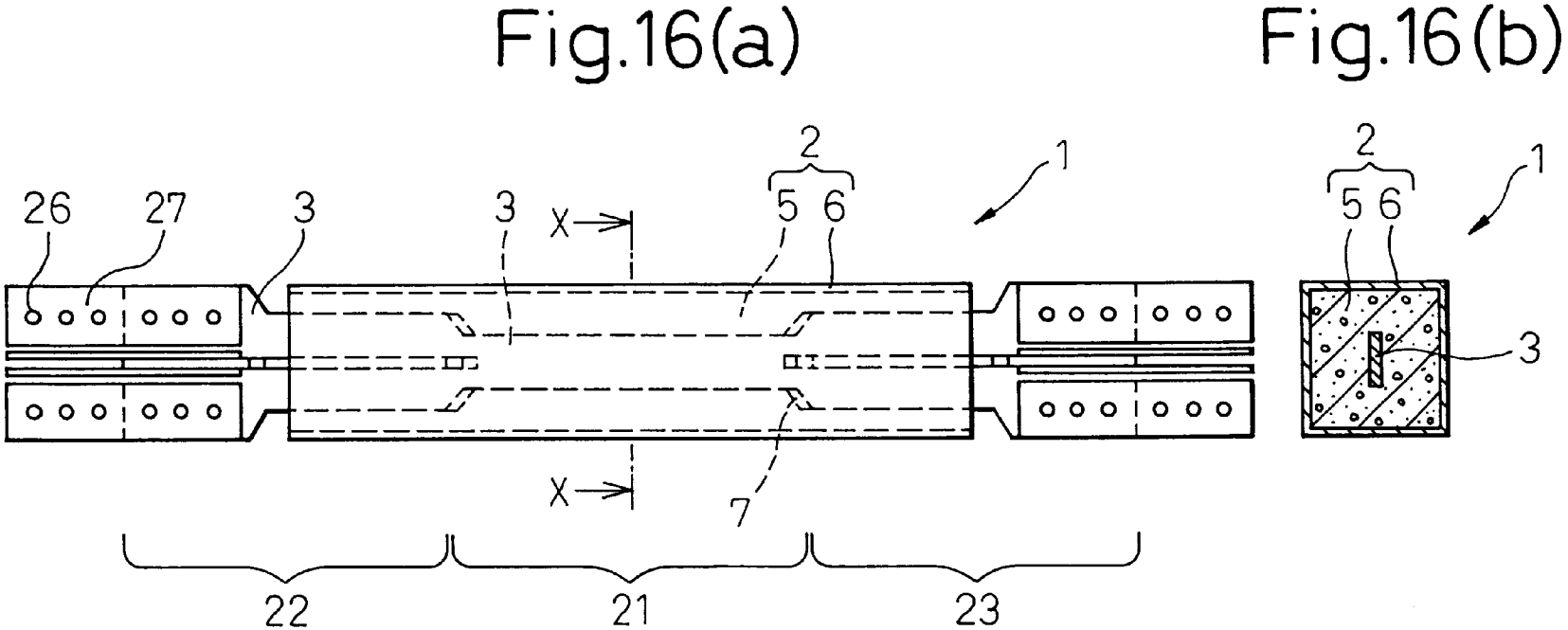
FIG. 16 (*a*) is a plan view of a buckling restrained brace of the present invention in which through holes for bolt insertion are provided at both ends of the steel-made center axial member.
Figure 17B:
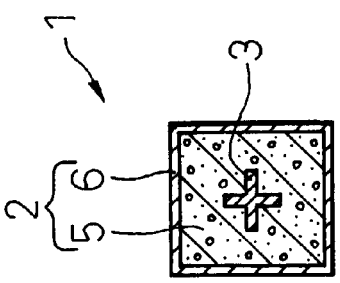
FIG. 17 (*a*) is a plan view of a buckling restrained brace of the present invention in which through holes for bolt insertion are provided at both ends of the steel-made center axial member.
Figure 17A:
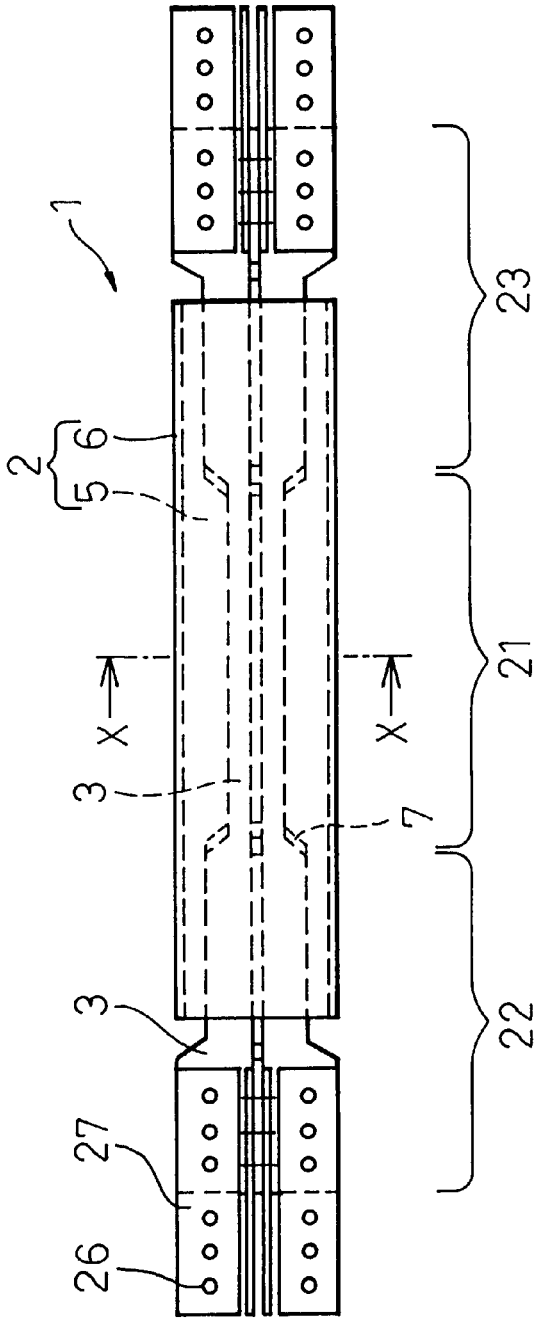
Figure 23A:
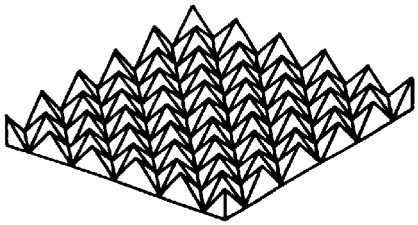
FIG. 23 (*a*) shows the shape of protrusions on a friction joint face.
Figure 23B:
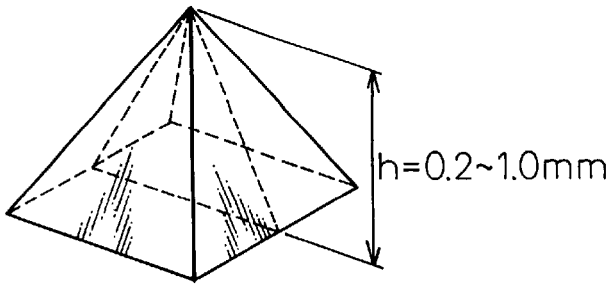

Buckling restrained braces and a damping steel structure were clamping jointed with high tensile bolts. As shown in FIGS. 16(*a*) and 16(*b*) and FIGS. 17(*a*) and 17(*b*), steel-made connecting plates 27 having a surface hardness (Vickers hardness) and a surface roughness (ten point average roughness) 1.3 times larger than the surface hardness and surface roughness of both ends 22, 23 of the steel-made center axial members were used. Alternatively, in the friction jointing with high tension bolts mentioned above, both ends 22, 23 of the steel-made center axial member and the steel made-connecting plates 27 forming one friction jointing face were joined by the following procedure: the ratio of a hardness of the frictional surface layer portion of one of the two steel materials to a hardness of the frictional surface layer portion of the other steel material is at least 2.5; the depth of the surface layer portion having a higher hardness is at least 0.2 mm; a plurality of triangular wave-shaped or pyramidal protrusions as shown in FIGS. 22 and 23 are provided on the surface of the steel material having a higher surface hardness in the surface layer portion, and the height of the protrusions is from 0.2 to 1.0 mm; and the maximum surface roughness of the surface of the steel material having a lower hardness in the surface layer portion is made sufficiently smaller than the height of the protrusions. Although the number of necessary high tension bolts was 12 when conventional friction jointing was conducted, the number of the bolts could be reduced to 6 when the present friction jointing was employed because the friction joint proof stress per bolt in the present friction jointing was at least doubled compared with the conventional friction jointing. Moreover, since the number of the bolts used was decreased, the plate width of both ends of the steel-made center axial member and that of the steel-made connecting plates could be made substantially comparable to or less than the width of the buckling-constraining concrete member 2. When the buckling restrained brace and the damping steel structure are to be stacking jointed without using the steel-made connecting plates, the friction face sides of both ends of the steel-made center axial member or those of the damping steel structure are favorably made larger than the other counterpart friction face sides.

As a result of defining the secant modulus in the thickness direction and the adhesion-preventive film ratio of the adhesive-preventive film between the buckling-constraining concrete member and the steel-made center axial member, the thickness of the adhesion-preventive film is required to have can be sufficiently ensured during pouring concrete. Moreover, when the steel-made center axial member yields and is plastic deformed, the expansion in the out-of-plane direction thereof can be sufficiently absorbed, and the local buckling thereof can be prevented.

As a result of defining the plasticized portion of a steel material used for the steel-made center axial member, the buckling restrained brace can be made to function as a hysteresis damper against an earthquake of a small magnitude. Plastic deformation of the ends of the steel-made center axial member caused by strain hardening can be avoided by making the cross-sectional area of each end thereof at least 1.2 times larger than that of the central portion.

The central portion in the longitudinal direction of the steel-made center axial member can be made to function as a hysteresis damper by making the cross-sectional area of the central portion minimum; an elastic state can be maintained at both ends thereof; therefore, fracture at joints between the buckling restrained brace and a main column-beam steel structure can be prevented.

When a reinforcing bar is used as a steel member of a buckling-constraining concrete member, the bending stiffness and the buckling effect of the buckling-constraining concrete member can be increased.

When a lid is provided to the steel-made center axial member, pouring concrete becomes easy, and cracked concrete can be prevented from falling.

Providing a slip stopper to the steel-made center axial member produces the following results. The buckling-constraining concrete member can be fixed to the central portion thereof; the clearance between the buckling-constraining concrete member and each expanded portion of both ends in the longitudinal direction thereof becomes definite, and the design can be easily made; the buckling-constraining concrete member can be prevented from gravity-caused slipping down.

According to the present invention, the friction joint proof stress can be made at least twice larger than that of the conventional bolt joint. As a result, the number of necessary bolts can be made half or less, and the buckling restrained brace and the damping steel structure can be fixing jointed with high tensile bolts without extremely expanding both ends of the steel-made center axial member.

Making a combination of the buckling restrained brace and the visco-elastic sheets in parallel for the purpose of absorbing energy of earthquakes of large and small magnitudes permits always absorbing vibration energy without depending on the magnitude of excited vibration amplitudes. Moreover, the absorbing capacity can be made larger than that of the buckling restrained brace alone.

When an earthquake of a large magnitude acts on a steel structure and its building in which buckling restrained braces are used as braces, the main structure is restored to the original position after the earthquake because the main structure is always in an elastic state, and continued use of the steel structure and its building is readily permitted by exchanging the plasticized buckling restrained braces alone.

What is claimed is:

1. A buckling restrained brace (1) wherein a steel-made center axial member (3) is passed through a buckling-constraining concrete member (2) comprising buckling-constraining concrete reinforced with a steel member, and an adhesion-preventive film (4) is provided at an interface between the steel-made center axial member (3) and buckling-constraining concrete (5), said buckling-constraining concrete member (2) having an axial direction and an outer perimeter, said steel member reinforcing said buckling-constraining concrete (5) comprising a plurality of reinforcing bars (6-2) arranged in the axial direction of the buckling-constraining concrete member (2) inside of the outer perimeter of the buckling constraining concrete member (2) and a plurality of hoop shaped reinforcing members (6-3) spaced from one another in the axial direction of the buckling-constraining concrete member (2) disposed in the buckling-constraining concrete (5) inside of the outer perimeter of the buckling-constraining concrete member (2) perpendicular to the axial direction and in cooperation with the plurality of reinforcing bars (6-2) arranged in the axail direction, the adhesion-preventive film (4) showing a secant modulus in a thickness direction of at least 0.1 $N/mm^2$ between a point which shows a compressive strain of 0% and a point which shows a compressive strain of 50% and up to 21,000 N/mm$^2$ between a point which shows a compressive strain of 50% and a point which shows a compressive strain of 75%, and having a thickness ($d_t$) in a plate thickness direction of the steel-made center axial member (3) and a thickness ($d_w$) in a plate width direction thereof from at least 0.5 to 10% of the plate thickness (t) and from at least 0.5 to 10% of the plate width (w), respectively.

2. A buckling restrained brace (1) wherein the steel-made center axial member (3) is passed through a buckling-constraining concrete member (2) comprising buckling-constraining concrete reinforced with a steel member, and an adhesion-preventive film (4) is provided at an interface between the steel-made center axial member (3) and buckling-constraining concrete (5);

said buckling-constraining concrete member (2) having a longitudinal length in an axial direction thereof and a first end and an opposite second end;

said steel-made center axial member (3) comprising a core plate having a longitudinal length in an axial direction thereof and a first end and an opposite second end, wherein the longitudinal length of said core plate of said core plate of said steel-made center axial member (3) is longer than the longitudinal length of said buckling-constraining concrete member (2);

said core plate of said steel-made center axial member (3) has a first cross-sectional area which is (a) located extending axially between said first end said core plate and said first end of said buckling-constraining concrete member (2) and (b) located extending axially between said opposite second end of said core plate and said opposite second end of said buckling-constraining concrete member (2);

said core plate of said steel-made center axial member (3) has a second cross-sectional area at a center portion (21) located extending axially within said buckling-constraining concrete member (2) between said first end and said opposite second end of said buckling-constraining concrete member (2), said core plate center portion (21) having a first end and a opposite second end;

said core plate of said steel-made center axial member (3) having a third cross-sectional area which is (a) located extending axially between said first end of said center portion (21) of said core plate and said first end of said buckling-constraining concrete member (2) and (b) located extending axially between said second opposite end of said center portion (21) of said core plate and said opposite second end of said buckling-constraining concrete member (2);

wherein said first cross-sectional area of said core plate is larger than said third cross-sectional area of said core plate and said second cross-sectional area of said core plate is smaller than said third cross-sectional area of said core plate;

the adhesion-preventive film (4) showing a secant modulus in a thickness direction of at least 0.1 N/mm$^2$ between a point which shows a compressive strain of 0% and a point which shows a compressive strain of 50% and up to 21,000 N/mm$^2$ between a point which shows a compressive strain of 50% and a point which shows a compressive strain of 75%, and having a thickness ($d_t$) in a plate thickness direction of the steel-made center axial member (3) and a thickness ($d_w$) in a plate width direction thereof from at least 0.5 to 10% of the plate thickness (t) and from at least 0.5 to 10% of the plate width (w), respectively.

3. A buckling restrained brace according to claim 2 further comprising:

said core plate of said-made center axial member (3) having a top surface and a bottom surface, said core plate further having a center located midway between said first end and said opposite second end of said core plate along the longitudinal length of said core plate;

a first rib plate located on said top surface of said core plate and a second rib plate located on said bottom surface of said core plate, said first rib plate and said second rib plate extending along the longitudinal length of said core plate between said first end of said core plate toward said center portion (21) of said core plate and terminating prior to said center of said core plate;

a third rib plate located on said top surface of said core plate and a fourth rib plate located on said bottom surface of said core plate, said third rib plate and said fourth rib plate extending along the longitudinal length of said core plate between said opposite second end of said core plate toward said center portion (21) of said core plate and terminating prior to said center of said core plate.

4. A buckling restrained brace (1) wherein a steel-made center axial member (3) is passed through a buckling-constraining concrete member (2) comprising buckling-constraining concrete reinforced with a steel member, and an adhesion-preventive film (4) is provided at an interface between the steel-made center axial member (3) and buckling-constraining concrete (5);

said buckling -constraining concrete member (2) having a longitudinal length in an axial direction thereof and a first end and an opposite second end;

said steel-made center axial member (3) having a longitudinal length in an axial direction thereof and a first end and an opposite second end, wherein the longitudinal length of steel-made center axial member (3) is longer than the longitudinal length of said buckling-constraining concrete member (2);

said steel-made center axial member (3) having a cross (+) shape cross-section along the longitudinal length of said steel-made center axial member (3);

said cross (+) shape cross-section of said steel-made center axial member (3) having a first cross-sectional area which is a (a) located extending axially between said first end of said steel-made center axial member (3) and said first end of said buckling-constraining concrete member (2) and (b) located extending axially between said opposite second end of said steel made center axial member (3) and said opposite second end of said buckling-constraining concrete member (2);

said cross (+) shape cross-section of said steel-made cnter axial member (3) having a second cross-sectional area at a center portion (21) located extending axially within said buckling-constraining concrete member (2) between said first end and said opposite second end of said buckling-constraining concrete member (2), said center portion (21) of said steel-made center axial member (3) having a first end and an opposite second end;

said cross (+) shape cross-section of said steel-made center axial member (3) having a third cross-sectional area which is (a) located extending axially between said first end of said center portion (21) of said steel-made center axial member (3) and said first end of said buckling-constraining concrete member (2) and (b) located extending axially between said opposite second end of said center portion (21) of said steel-made center axial member (3) and said opposite second end of said buckling-constraining concrete member (2);

wherein said first cross-sectional area of said cross (+) shape cross-section of said steel-made center axial member (3) is larger than said third cross-sectional area of said cross (+) shape cross-section of said steel-made center axial member (3) and said second cross-sectional area of said cross (+) shape cross-section of said steel-made center axial member (3) is smaller than said third cross-section of said cross (+) shape cross-section of said steel-made center axial member (3);

the adhesion-preventive film (4) showing a secant modulus in a thickness direction of at least 0.1 $N/mm^2$ between a point which shows a compressive strain of 0% and a point which shows a compressive strain of 50% and up to 21,000 $N/mm^2$ between a point which shows a compressive strain of 50% and a point which shows a compressive strain of 75%, and having a thickness ($d_t$) in a plate thickness direction of the steel-made center axial member (3) and a thickness ($d_w$) in a plate width direction thereof from at least 0.5 to 10% of the plate thickness (t) and from at least 0.5 to 10% of the plate width (w), respectively.

5. A buckling restrained brace (1) wherein the steel-made center axial member (3) is passed through a buckling-constraining concrete member (2) comprising buckling-constraining concrete reinforced with a steel member, and an adhesion-preventive film (4) is provided at an interface between the steel-made center axial member (3) and buckling-constraining concrete (5);

said buckling-constraining concrete member (2) having a longitudinal length in an axial direction thereof and a first end and an opposite second end;

said steel-made center axial member (3) comprising a core plate having a longitudinal length in an axial direction thereof and a first end and an opposite second end, wherein the longitudinal length of said core plate of said core plate of said steel-made center axial member (3) is longer than the longitudinal length of said buckling-constraining concrete member (2);

said core plate of said steel-made center axial member (3) has a first cross-sectional area which is (a) located extending axially between said first end said core plate and said first end of said buckling-constraining concrete member (2) and (b) located extending axially between said opposite second end of said core plate and said opposite second end of said buckling-constraining concrete member (2);

said core plate of said steel-made center axial member (3) has a second cross-sectional area at a center portion (21) located extending axially within said buckling-constraining concrete member (2) between said first end and said opposite second end of said buckling-constraining concrete member (2), said core plate center portion (21) having a first end and a opposite second end;

said core plate of said steel-made center axial member (3) having a third cross-sectional area which is (a) located extending axially between said first end of said center portion (21) of said core plate and said first end of said buckling-constraining concrete member (2) and (b) located extending axially between said second opposite end of said center portion (21) of said core plate and said opposite second end of said buckling-constraining concrete member (2);

wherein said first cross-sectional area of said core plate is larger than said third cross-sectional area of said core plate and said second cross-sectional area of said core plate is smaller than said third cross-sectional area of said core plate.

6. A buckling restrained brace according to claim 5, further comprising:

said core plate of said-made center axial member (3) having a top surface and a bottom surface, said core plate further having a center located midway between said first end and said opposite second end of said core plate along the longitudinal length of said core plate;

a first rib plate located on said top surface of said core plate and a second rib plate located on said bottom surface of said core plate, said first rib plate and said second rib plate extending along the longitudinal length of said core plate between said first end of said core plate toward said center portion (21) of said core plate and terminating prior to said center of said core plate;

a third rib plate located on said top surface of said core plate and a fourth rib plate located on said bottom surface of said core plate, said third rib plate and said fourth rib plate extending along the longitudinal length of said core plate between said opposite second end of said core plate toward said center portion (21) of said core plate and terminating prior to said center of said core plate.

7. A buckling restrained brace (1) wherein a steel-made center axial member (3) is passed through a buckling-constraining concrete member (2) comprising buckling-constraining concrete reinforced with a steel member, and an adhesion-preventive film (4) is provided at an interface between the steel-made center axial member (3) and buckling-constraining concrete (5);

said buckling -constraining concrete member (2) having a longitudinal length in an axial direction thereof and a first end and an opposite second end;

said steel-made center axial member (3) having a longitudinal length in an axial direction thereof and a first end and an opposite second end, wherein the longitudinal length of steel-made center axial member (3) is longer than the longitudinal length of said buckling-constraining concrete member (2);

said steel-made center axial member (3) having a cross (+) shape cross-section along the longitudinal length of said steel-made center axial member (3);

said cross (+) shape cross-section of said steel-made center axial member (3) having a first cross-sectional area which is a (a) located extending axially between said first end of said steel-made center axial member (3) and said first end of said buckling-constraining concrete member (2) and (b) located extending axially between said opposite second end of said steel made center axial member (3) and said opposite second end of said buckling-constraining concrete member (2);

said cross (+) shape cross-section of said steel-made cnter axial member (3) having a second cross-sectional area at a center portion (21) located extending axially within said buckling-constraining concrete member (2) between said first end and said opposite second end of said buckling-constraining concrete member (2), said center portion (21) of said steel-made center axial member (3) having a first end and an opposite second end;

said cross (+) shape cross-section of said steel-made center axial member (3) having a third cross-sectional area which is (a) located extending axially between said first end of said center portion (21) of said steel-made center axial member (3) and said first end of said buckling-constraining concrete member (2) and (b) located extending axially between said opposite second end of said center portion (21) of said steel-made center axial member (3) and said opposite second end of said buckling-constraining concrete member (2);

wherein said first cross-sectional area of said cross (+) shape cross-section of said steel-made center axial member (3) is larger than said third cross-sectional area of said cross (+) shape cross-section of said steel-made center axial member (3) and said second cross-sectional area of said cross (+) shape cross-section of said steel-made center axial member (3) is smaller than said third cross-section of said cross (+) shape cross-section of said steel-made center axial member (3).

8. A buckling restrained brace (1) wherein a steel-made center axial member (3) is passed through a buckling-constraining concrete member (2) comprising buckling-constraining concrete reinforced with a steel member, and an adhesion-preventive film (4) is provided at an interface between the steel-made center axial member (3) and buckling-constraining concrete (5), said buckling-constraining concrete member (2) having an axial direction and an outer perimeter, said steel member reinforcing said buckling-constraining concrete (5) comprising a plurality of reinforcing bars (6-2) arranged in the axial direction of the buckling-constraining concrete member (2) inside of the outer perimeter of the buckling constraining concrete member (2) and a plurality of hoop shaped reinforcing members (6-3) spaced from one another in the axial direction of the buckling-constraining concrete member (2) disposed in the buckling-constraining concrete (5) inside of the outer perimeter of the buckling-constraining concrete member (2) perpendicular to the axial direction and in cooperation with the plurality of reinforcing bars (6-2) arranged in the axail direction.

9. A buckling restrained brace according to claim 5 or 7, wherein the steel-made center axial member (3) is a steel material showing a 0.2% proof stress or a yield point stress of up to 130 $N/mm^2$.

10. A buckling restrained brace according to claim 5 or 7, wherein the steel-made center axial member (3) is a steel material showing a 0.2% proof stress or a yield point stress of 130 to 245 $N/mm^2$.

11. A buckling restrained brace according to claim 5 or 7, wherein the steel-made center axial member (3) shows an axial equivalent stiffness of at least 1.5 times that of the steel-made center axial member (3) which has a same-sectional area from one end to the other end, passing through the central portion (21) in the length direction of said member (3).

12. A buckling restrained brace according to claim 5 or 7, wherein lid (24) is fixed to at least one end of the buckling-constraining concrete member (2).

13. A buckling restrained brace according to claim 5 or 7, wherein slip stopper (25) is provided at the center of the steel-made center axial member (3).

14. A buckling restrained brace according to claim 5 or 7, wherein the steel-made center axial member (3) is provided with through holes (26) for bolt insertion passing at both ends (22, 23), and steel-made connecting plates (27) are friction jointed with high tension bolts by clamping, wherein friction face sides at both ends (22, 23) of the steel-made center axial member (3) which are contacted with respective friction face sides of the steel-made connecting plates (27) or the friction face sides of the steel-made connecting plates (27) which are contacted with the respective friction face sides at both ends (22, 23) of the steel-made center axial member are made to have a higher surface hardness and a higher surface roughness than counterpart friction face sides.

15. A buckling restrained brace according to claims 5 or 7, wherein at least one set comprising three layers which are formed from a C-shaped cross-sectional inside steel plate (29), a visco-elastic sheet (30) and a C-shaped cross-sectional outside steel plate (31) is fastened to each of the sides of the buckling-constraining concrete member (2) of the buckling restrained brace (1), one end (32) of the C-shaped cross-sectional inside steel plate (29) is fastened to one end (34) of the buckling restrained brace (1), and the other end (33) of the C-shaped cross-sectional outside steel plate (31) is fastened to the other end (35) of the buckling restrained brace (1) in the direction opposite to the one end (32) of the C-shaped cross-sectional outside steel plate (29).

16. A damping steel structure (38) wherein the buckling restrained braces (1) according to claim 5 or 7 are placed in the damping steel structure (38) which is formed with columns (36) and beams (37) prepared from a steel material showing a yield point stress higher than that of the steel-made center axial members (3) of the buckling restrained braces (1), the buckling restrained braces (1) showing both elastic and plastic behavior when the damping steel structure (38) vibrates under vibration action, and the damping steel structure (38) which is formed with the columns and the beams, showing elastic behavior.

* * * * *